US008090140B2

(12) United States Patent
Suzuki et al.

(10) Patent No.: US 8,090,140 B2
(45) Date of Patent: Jan. 3, 2012

(54) SPEAKER AND METHOD OF OUTPUTTING ACOUSTIC SOUND

(75) Inventors: Nobukazu Suzuki, Kanagawa (JP); Masaru Uryu, Chiba (JP); Yoshio Ohashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 1345 days.

(21) Appl. No.: 11/565,167

(22) Filed: Nov. 30, 2006

(65) Prior Publication Data

US 2007/0133837 A1 Jun. 14, 2007

(30) Foreign Application Priority Data

Dec. 9, 2005 (JP) ..... 2005-356751

(51) Int. Cl.
*H04R 1/00* (2006.01)
*H04R 1/20* (2006.01)
*H04R 25/00* (2006.01)

(52) U.S. Cl. ..... 381/423; 381/338; 381/152

(58) Field of Classification Search ..... 381/152, 381/190, 338, 386, 423, 431; 181/152, 153, 181/156, 196, 198
See application file for complete search history.

(56) References Cited

U.S. PATENT DOCUMENTS

| | | | | |
|---|---|---|---|---|
| 3,033,944 | A | 5/1962 | McCreary | |
| 4,817,152 | A | 3/1989 | Lee | |
| 2003/0007653 | A1 * | 1/2003 | Azima et al. | 381/431 |
| 2005/0053257 | A1 * | 3/2005 | Johnson et al. | 381/431 |

FOREIGN PATENT DOCUMENTS

| | | |
|---|---|---|
| JP | 57-121398 | 7/1982 |
| JP | 62-278900 | 12/1987 |
| JP | 2-309799 | 12/1990 |
| JP | 3-273800 | 12/1991 |
| JP | 04-313999 | 11/1992 |
| JP | 4-358499 | 12/1992 |
| JP | 5-236595 | 9/1993 |
| JP | 9-247790 | 9/1997 |
| JP | 11-113088 | 4/1999 |
| JP | 11-220786 | 8/1999 |
| JP | 2000-350285 | 12/2000 |

OTHER PUBLICATIONS

U.S. Appl. No. 12/769,132, filed Apr. 28, 2010, Suzuki, et al.
Extended Search Report issued Nov. 18, 2010 in EP Application No. 10180280.9.
Office Action issued Dec. 22, 2010, in Japan Patent Application No. 2005-356751.

* cited by examiner

*Primary Examiner* — Brian Ensey
(74) *Attorney, Agent, or Firm* — Oblon, Spivak, McClelland, Maier & Neustadt, L.L.P.

(57) ABSTRACT

A speaker has an acoustic diaphragm, and an actuator that is driven based on an acoustic signal. The actuator has a transmission portion that is directly or indirectly attached to the acoustic diaphragm and transmits a displacement output of the actuator to the acoustic diaphragm. The actuator vibrates with the acoustic diaphragm by at least its component of the vibration along a plane of the acoustic diagram.

19 Claims, 27 Drawing Sheets

SPEAKER AND METHOD OF OUTPUTTING ACOUSTIC SOUND

CROSSREFERENCE TO RELATED APPLICATION

The present invention contains subject matters related to Japanese Patent Application JP 2005-356751 filed in the Japanese Patent Office on Dec. 9, 2005, the entire contents of which being incorporated herein by reference.

BACKGROUND OF THE INVENTION

1. Field of the Invention

The present invention relates to a speaker and a method of outputting acoustic sound. More particularly, it relates to a speaker and the like in which an actuator driven based on an acoustic signal is used to vibrate with a diaphragm, thereby obtaining an acoustic output.

2. Description of Related Art

Japanese Patent Application Publication No. H04-313999 has disclosed a speaker, in which a magnetostrictive actuator is used to vibrate with a diaphragm, thereby obtaining an acoustic output sound. The magnetostrictive actuator is referred to as an actuator in which a magnetostrictive element whose form can alter by applying an external magnetic field thereto is used.

FIG. 1 shows a configuration of an acoustic output device 300 for obtaining an acoustic output. This acoustic output device 300 has a player 301, an amplifier 302, a magnetostrictive actuator 303, and a diaphragm 304. In this device 300, the magnetostrictive actuator 303 and the diaphragm 304 constitutes a speaker 305.

The player 301 reproduces, for example, a compact disc (CD), a mini disc (MD), a digital versatile disc (DVD) and outputs an acoustic signal thereof. The amplifier 302 receives this acoustic signal from the player 301 and then, amplifies and supplies it to the magnetostrictive actuator 303. The magnetostrictive actuator 303 has a driving rod 303*a* for transmitting any displacement outputs. A tip of the driving rod is attached to the diaphragm 304.

The magnetostrictive actuator 303 drives the diaphragm 304 based on the acoustic signal. In other words, the driving rod 303*a* of the magnetostrictive actuator 303 is displaced corresponding to a waveform of the acoustic signal, so that this displacement can be transmitted to the diaphragm 304. This enables the diaphragm 304 to output an acoustic sound corresponding to the acoustic signal.

SUMMARY OF THE INVENTION

In the above speaker 305 of the acoustic output device 300, however, the driving rod 303*a* of the magnetostrictive actuator 303 is attached to a plane of the diaphragm 304 and the magnetostrictive actuator 303 vibrates with the diaphragm 304 by only a vibration component orthogonal to the plane of the diaphragm 304 to obtain the acoustic output.

In this device, the diaphragm 304 vibrates loudly at its vibration point. A listener may listen to a sound wave from the vibration point being sounded very loud, as compared by that from another position. This causes an acoustic image to be localized to the vibration point. Thus, in the acoustic output device 300, it is difficult to obtain a global acoustic image.

It is desirable to provide a speaker and a method of outputting acoustic sound that are capable of providing such a global acoustic image.

According to an embodiment of the present invention, there is provided a speaker having an acoustic diaphragm and an actuator that is driven based on an acoustic signal. A transmission portion of the actuator that is attached to the acoustic diaphragm and transmits a displacement output of the actuator to the acoustic diaphragm. The actuator vibrates with the acoustic diaphragm by at least its component of the vibration along a plane of the acoustic diaphragm.

The speaker according to an embodiment of the invention has the acoustic diaphragm and the actuator, as described above. The acoustic diaphragm has shapes of, for example, a tube, a plate, a rod, a ball shell, a ball, a funnel, a cone, and a wineglass. For example, the acoustic diagram of tube may be made of rolled plate member, by which the speaker is easily manufactured. This acoustic diaphragm vibrates by actuation of the actuator that is driven based on an acoustic signal. As the actuator, for example, a magnetostrictive actuator or a speaker unit is used.

The transmission portion of the actuator that transmits a displacement output of the actuator to the acoustic diaphragm is attached to the acoustic diaphragm. The actuator vibrates with the acoustic diaphragm by at least its component of the vibration along a plane of the acoustic diaphragm. In this embodiment, the component of the vibration along the plane of the acoustic diaphragm increases as a displace direction of transmission portion of the actuator nears the plane direction of the acoustic diaphragm. For example, if the acoustic diaphragm has an end surface, the actuator vibrates with the acoustic diaphragm by at least its component of vibration orthogonal to the end surface of the acoustic diaphragm.

Thus, the actuator vibrates with the acoustic diaphragm by its component of the vibration along a plane of the acoustic diaphragm, which is a component of vibration parallel to the plane of the acoustic diaphragm, so that an elastic wave based on an acoustic signal propagates in the plane direction of the acoustic diaphragm. This elastic wave repeats mode exchanges of a longitudinal wave to a transverse wave and vice versa when the elastic wave propagates in the acoustic diaphragm, so that the longitudinal wave and the transverse wave can be mingled therein. The transverse wave excites vibration along a plane direction of an acoustic diaphragm (i.e., a direction orthogonal to the end surface of the acoustic diaphragm). This enables the diaphragm to emit sound wave to an outside, thereby obtaining an acoustic output.

Thus, the actuator vibrates with the acoustic diaphragm by its component of the vibration along a plane of the acoustic diaphragm, which prevents large transverse wave from occurring at a vibration point. Therefore, a listener does not listen to sound wave from the vibration point being sounded very loud, as compared by that from another position, so that an acoustic image can be created over a whole of the acoustic diaphragm. This causes a global acoustic image to be obtained.

As the acoustic diaphragm, the acoustic diaphragm having a cup shape can be used. The transmission portion of the actuator is attached to an open end surface of the acoustic diaphragm having the cup shape. In this speaker, the elastic wave that has propagated to the acoustic diaphragm from the open end surface thereof propagates up to a bottom of the acoustic diaphragm having the cup shape. This enables the bottom thereof to emit sound wave to outside, which enhances the global acoustic image.

For example, the actuator is set on a base casing and the acoustic diaphragm is set on the base casing through a damper member. Thus, the acoustic diaphragm is set on the base casing through the damper member, which prevents any vibration (elastic wave) by the actuator from propagating to the base casing and localizing the acoustic image on the base casing side.

The acoustic diaphragm may be detachably set on the base casing when setting it. This enables an optional acoustic diaphragm to be selected among a plural species of acoustic diaphragms having different materials, sizes, and shapes in order to be mounted thereon, thereby obtaining a species of tones, looks, and the like.

For example, a plurality of the actuators can be provided. The transmission portions of the actuators are respectively attached to different positions of the acoustic diaphragm. For example, driving the plurality of the actuators based on, for example, the same acoustic signal allows omni-directionality to be obtained. Further, driving the plurality of the actuators respectively by the separate acoustic signals, for example, the acoustic signals of plural channels, plural acoustic signals obtained by adjusting the identical acoustic signal independently on its level, its delay time, or its frequency characteristic, or the like allows to be implemented any sound field processing to enhance the global acoustic image.

For example, the acoustic diaphragm can be made of a plurality of split acoustic diaphragms that are completely or partially away from each other. In this speaker, the transmission portions of the plurality of the actuators are respectively attached to the corresponding split acoustic diaphragms, thereby securing independency on vibration of each of the actuators. This allows, for example, the above sound field processing to be effectively performed.

For example, the acoustic diaphragm may be set with its one end being put at the lower side, and the actuator may be mounted on the other end of the acoustic diaphragm with the transmission portion of the actuator being attached to the other end of the acoustic diaphragm. This enables the actuator without any fixation to propagate its vibration to the acoustic diaphragm by inertial force, thereby causing a less distortion in the sound image because the actuator is not restrained.

Since, according to the embodiment of the invention, the transmission portion of the actuator which transmits a displacement output thereof to the acoustic diaphragm is attached to the acoustic diaphragm and the actuator vibrates with the acoustic diaphragm by at least its component of the vibration along the plane of the acoustic diaphragm, it is possible to obtain a global acoustic image.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DESCRIPTION OF THE PREFERRED EMBODIMENTS

The following will describe embodiments of the present invention with reference to the accompanied drawings.

Figure 1:
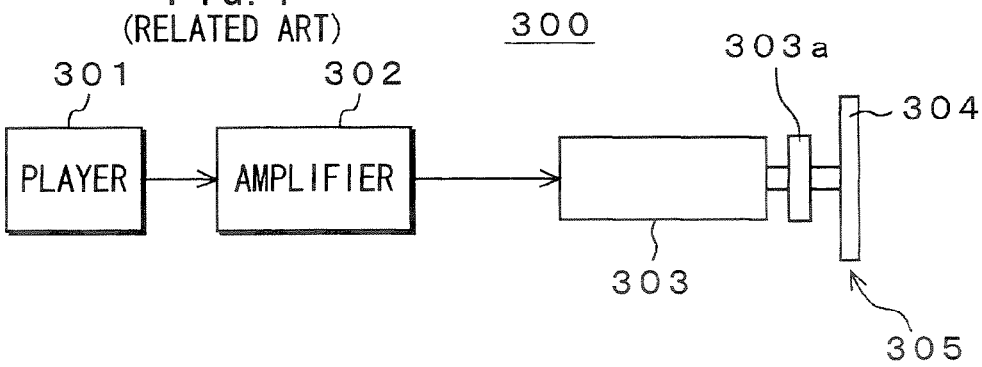
FIG. 1 (RELATED ART)
FIG. 1 is a block diagram for illustrating a configuration of an acoustic output device, as a related art, in which a magnetostrictive actuator is used.
Figure 2:
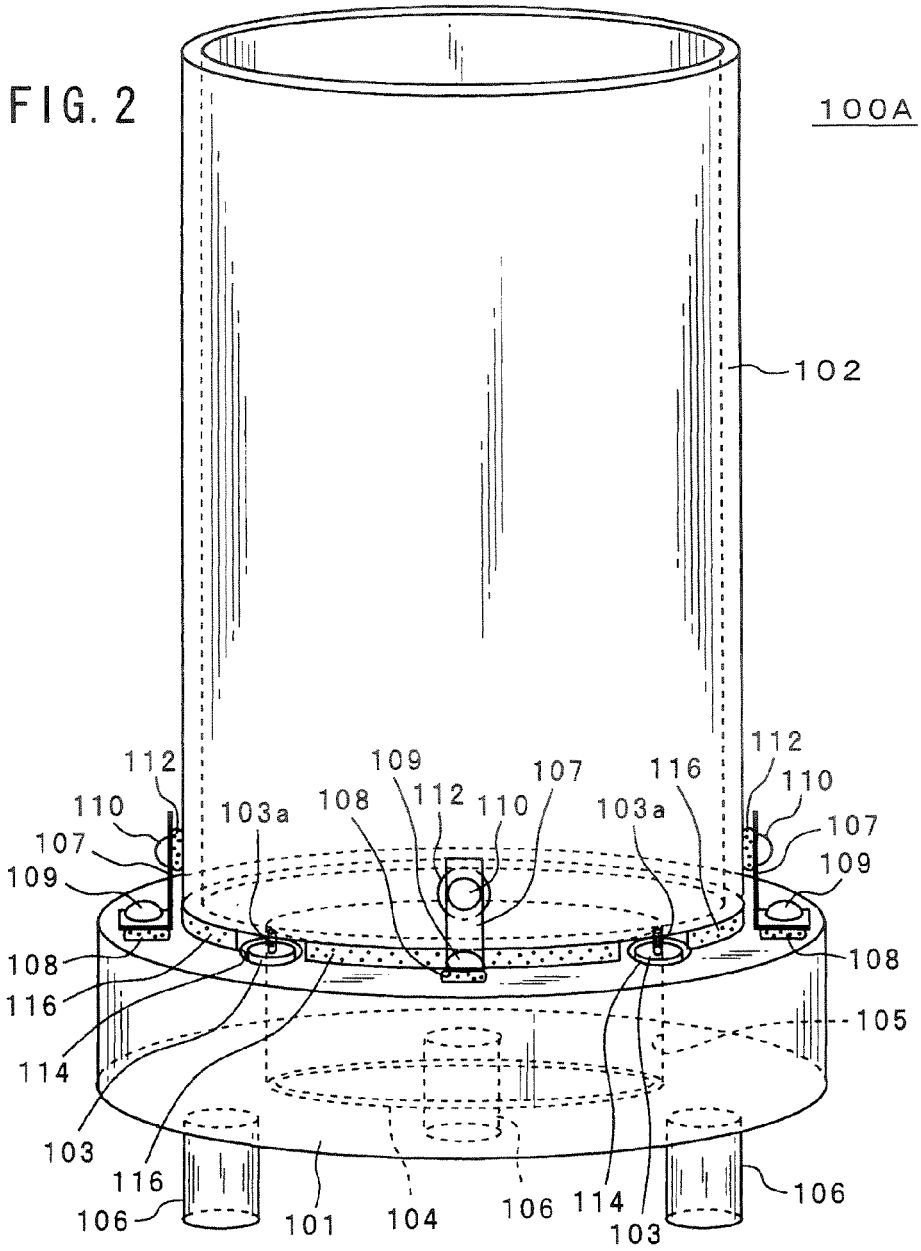
FIG. 2 is a perspective view of a speaker 100A according to an embodiment of the invention.
Figure 3:
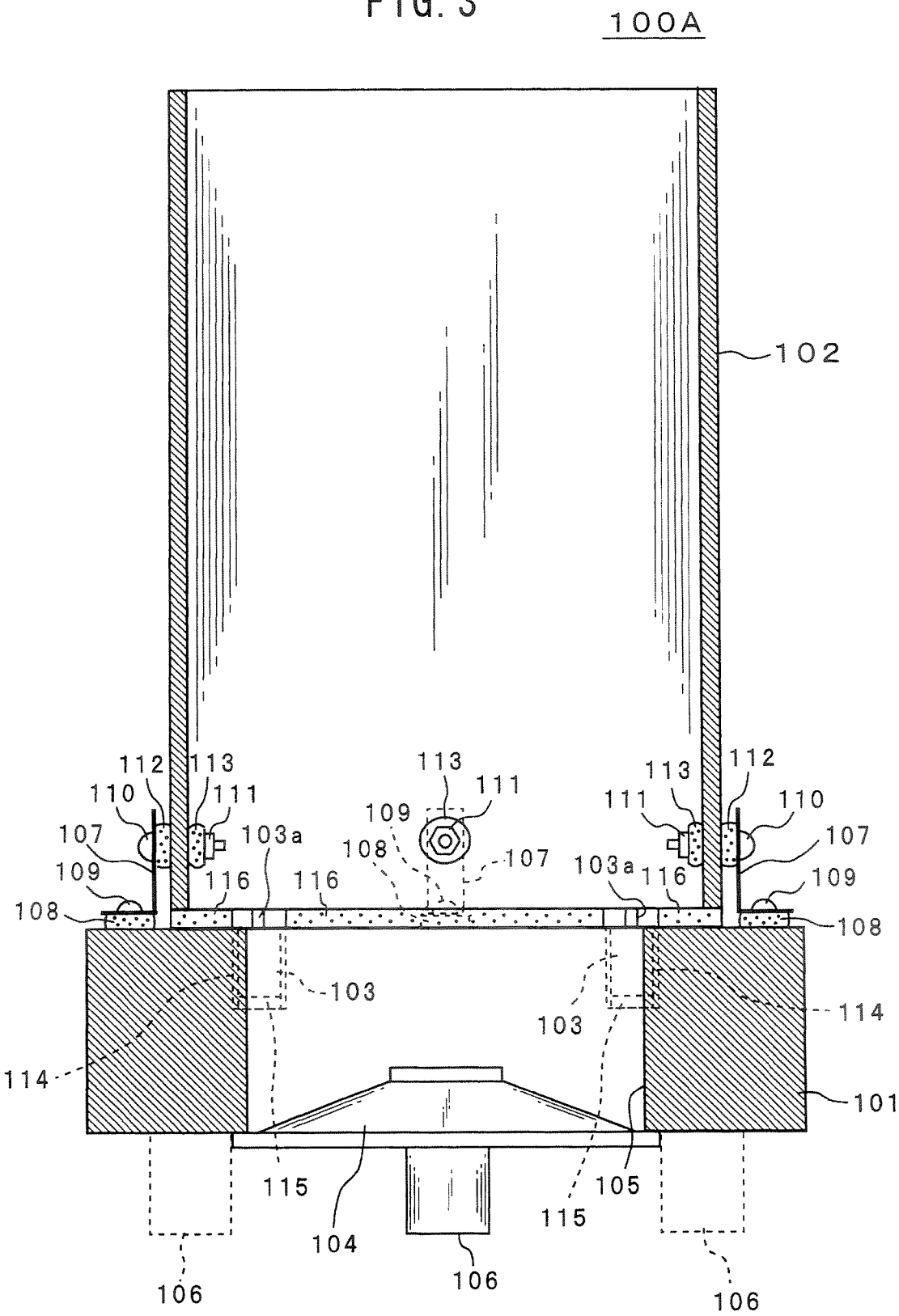
FIG. 3 is a vertical sectional view of the speaker 100A according to the embodiment of the invention.
Figure 4:
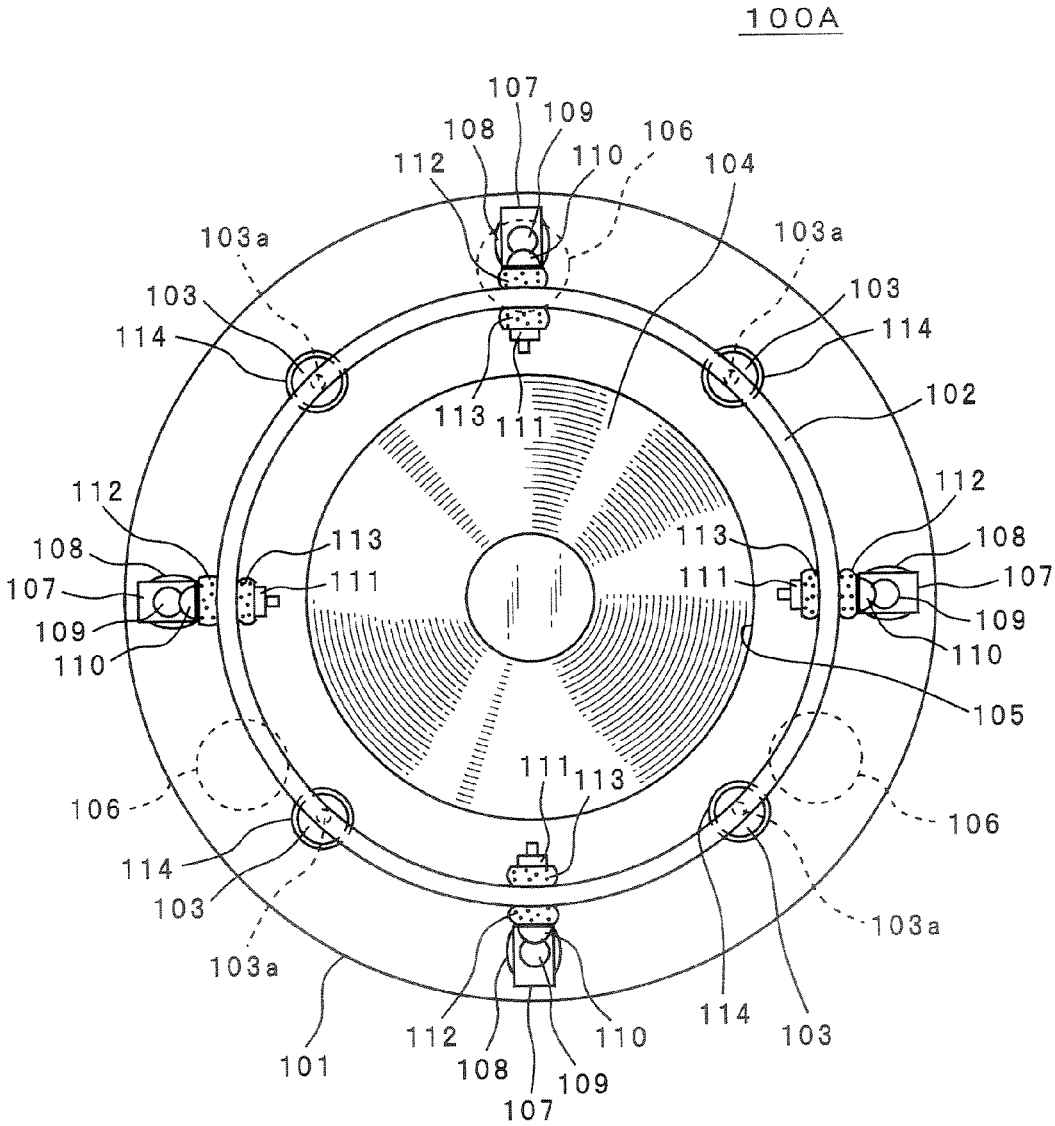
FIG. 4 is a top plan view of the speaker 100A according to the embodiment of the invention.
Figure 5:
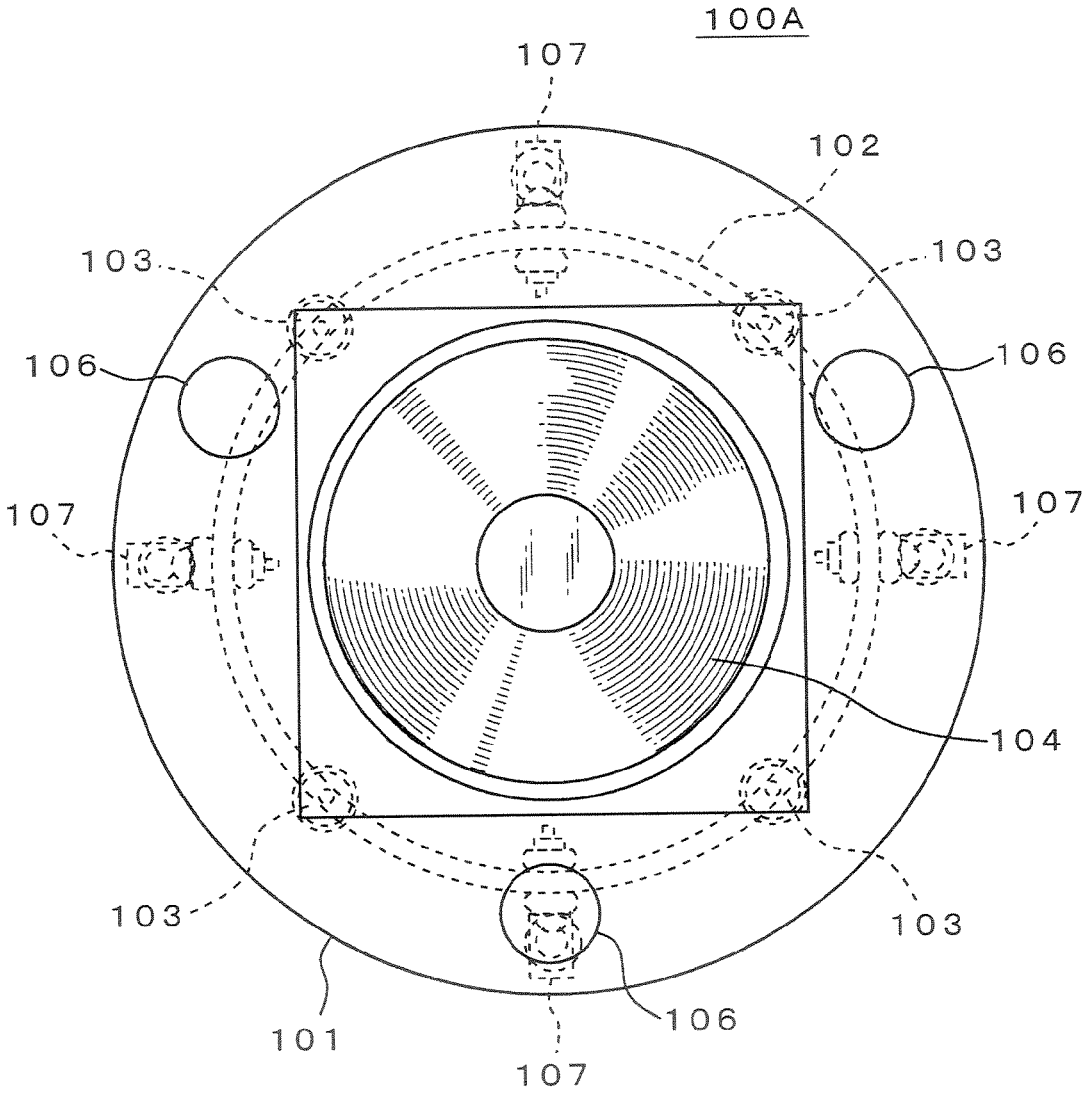
FIG. 5 is a bottom plan view of the speaker 100A according to the embodiment of the invention.

FIGS. 2 through 5 show a configuration of an embodiment of a speaker according to the invention. FIG. 2 is a perspective view of a speaker 100A according to an embodiment of the invention; FIG. 3 is a vertical sectional view thereof; FIG. 4 is a top plan view thereof; and FIG. 5 is a bottom plan view thereof.

The speaker 100A has a base casing 101, a pipe member 102, a magnetostrictive actuator 103 as an actuator, and a speaker unit 104. The pipe member 102 constitutes a diaphragm of tube as an acoustic diaphragm. A driving rod 103*a* of the magnetostrictive actuator 103 constitutes a transmission portion which transmits a displacement output of the magnetostrictive actuator 103.

The base casing 101 is made of, for example, synthetic resin. This base casing 101 has a shape like a disk as a whole and a cylindrical opening 105 passing through it at a center portion thereof. This base casing 101 also has a predetermined number of legs 106, in this embodiment, three legs, at the same distance along a lower outer circumference portion.

If the base casing 101 has three legs 106, it is possible to implement a more stable setting thereof than a case where the base casing 101 has four legs because these three legs 106 may be necessarily contacted to any places to be contacted. Further, providing a bottom surface of the base casing 101 with the legs 106 enables the bottom surface thereof to be away from the places to be contacted, thereby allowing sound wave emitted from the speaker unit 104 that is provided under the base casing 101 to be projected toward outside.

The pipe member 102 is made of, for example, a predetermined material such as a transparent acrylic resin. The pipe member 102 is set on the base casing 101. Namely, a lower end portion of the pipe member 102 is set on a top surface of the base casing 101 at a plurality of positions, in this embodiment, four positions by using L-shaped metal angles 107. A size of the pipe member 102 relates to the one having, for example, a length of 1000 mm; a diameter of 100 mm and a thickness of 2 mm.

In both ends of the L-shaped metal angles 107, round holes for a screw, not shown, are bored. An end of the L-shaped angle 107 is screwed to the top surface of the base casing 101 by a screw 109. Each screw hole, not shown, to which a screw thread of the screw 109 is secured is formed in the base casing 101. The end of the L-shaped angle 107 is secured to the top surface of the base casing 101 through a damper member 108 constituted of ring-shaped rubber member.

The other end of the L-shaped angle 107 is secured to a lower end portion of the pipe member 102 by a screw 110 and a nut 111. Each screw hole, not shown, to which a screw thread of the screw 110 is secured is formed in the lower end portion of the pipe member 102. Damper members 112, 113 each constituted of ring-shaped rubber member stand between the other end of the L-shaped angle 107 and an outer surface of the pipe member 102 and between the nut 111 and an inner surface of the pipe member 102.

The damper members 108, 112, 113 thus intervened prevent any vibration (elastic wave) by the magnetostrictive actuator 103 from propagating to the base casing 101 through the pipe member 102 and the L-shaped angles 107, thereby avoiding localizing any sound image to the base casing 101.

Plural magnetostrictive actuators 103, in this embodiment, four magnetostrictive actuators are set on the base casing 101. These four magnetostrictive actuators 103 are positioned at the same distance under and along a circular lower end surface of the pipe member 102. On the top surface of the base casing 101, hollows 114 each for containing the magnetostrictive actuator 103 are formed. The magnetostrictive actuators 103 are respectively set on the base casing 101 with them being respectively contained in the hollows 114.

Each of the magnetostrictive actuators 103 is set on a bottom of the hollow 114 in the base casing 101 through a damper member 115 constituted of ring-shaped rubber member. The damper member 115 thus intervened prevents any vibration by the magnetostrictive actuator 103 from propagating to the base casing 101, thereby avoiding localizing any sound image to the base casing 101.

When each of the magnetostrictive actuators 103 is set on the base casing 101 with them being contained in the hollows 114 thereof, the driving rod 103*a* of each of the magnetostrictive actuators 103 is attached to the lower end surface of the pipe member 102. In this moment, a displacement direction of each of the driving rods 103*a* is oriented to a direction orthogonal to the lower end surface of the pipe member 102, namely, an axial direction of the pipe member 102. This axial direction corresponds to a direction along a plane of the pipe member 102 (a direction parallel to the plane of the pipe member 102). Such a configuration enables the magnetostrictive actuators 103 to vibrate with the lower end surface of the pipe member 102 by their component of the vibration that is orthogonal to the lower end surface of the pipe member 102.

Figure 6:
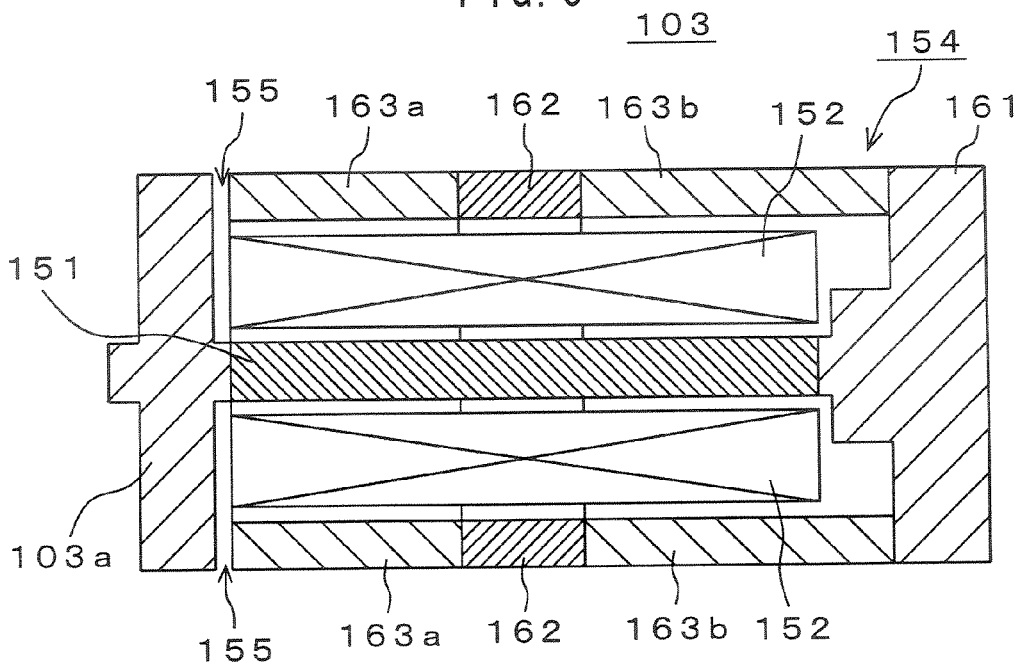
FIG. 6 is a sectional schematic view of a magnetostrictive actuator.

FIG. 6 shows a configuration of the magnetostrictive actuator 103. The magnetostrictive actuator 103 has a rod-like magnetostrictive element 151 that is displaced along its extension direction, a solenoid coil 152 for generating a magnetic field, which is positioned around this magnetostrictive element 151, a driving rod 103*a* as driving member, which is connected to an end of the magnetostrictive element 151 and transmits any displacement output of the magnetostrictive actuator 103, and a container 154 that contains the magnetostrictive element 151 and the solenoid coil 152 therein.

The container 154 is constituted of a fixed disk foot 161, a permanent magnet 162, and tubular cases 163*a*, 163*b*. The other end of the magnetostrictive element 151 is connected to the fixed disk foot 161 that supports the magnetostrictive element 151. The permanent magnet 162 that applies a biased static magnetic field to the magnetostrictive element 151 and the tubular cases 163*a*, 163*b* that constitute a magnetic circuit are positioned around the magnetostrictive element 151 that they enclose. The tubular cases 163*a*, 163*b* are installed on both of sides, sides of the driving rod 103*a* and the fixed disk foot 161, of the permanent magnet 162. These tubular cases 163*a*, 163*b* are made of ferromagnetic materials so that the biased static magnetic field can be effectively applied to the magnetostrictive element 151. If the fixed disk foot 161 is also made of ferromagnetic materials, the biased static magnetic field can be more effectively applied to the magnetostrictive element 151.

There is a gap 155 between the driving rod 103*a* and the container 154. The driving rod 103*a* is made of ferromagnetic materials, so that it can be pulled by the permanent magnet 162. Such a configuration enables the magnetic force of pull-in to occur between the driving rod 103*a* and the container 154. Thus, the magnetic force of pull-in allows a pre-load to be applied against the magnetostrictive element 151 connected to the driving rod 103*a*.

Figure 7:
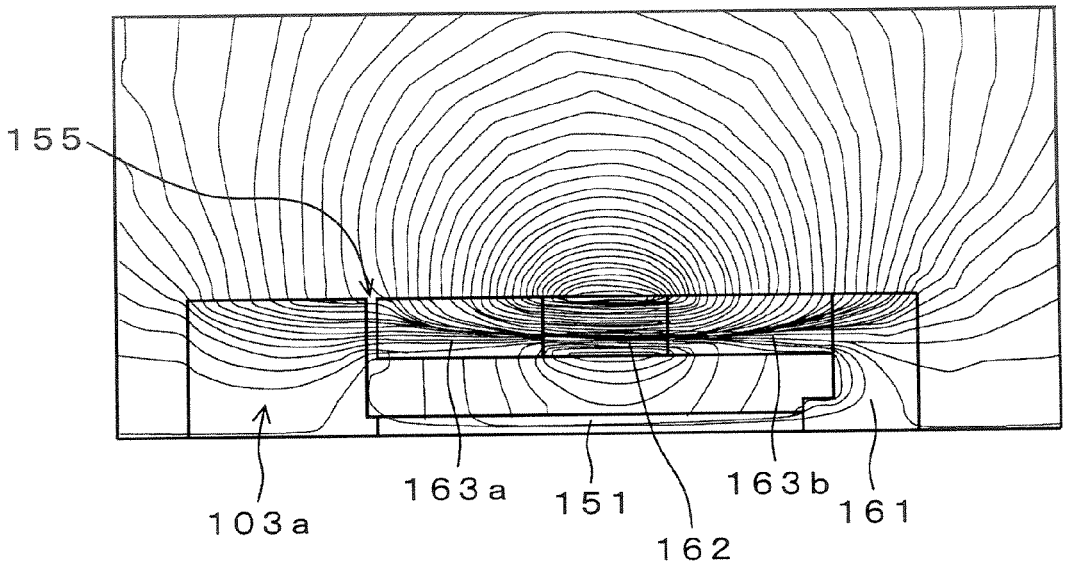
FIG. 7 is a diagram for showing lines of magnetic induction.

FIG. 7 shows lines of magnetic induction in the magnetostrictive actuator 103 shown in FIG. 6. The lines of magnetic induction start from the permanent magnet 162, passes through the tubular case 163*a*, the gap 155, the driving rod 103*a*, and the fixed disk foot 161, and returns to the permanent magnet 162 via the tubular case 163*b*. This causes the magnetic force of pull-in to occur between driving rod 103*a* and the container 154 so that the magnetic force of pull-in allows a pre-load to be applied against the magnetostrictive element 151. A part of the lines of magnetic induction starts from the permanent magnet 162, passes through the tubular case 163*a*, the gap 155, the driving rod 103*a*, the magnetostrictive element 151, and the fixed disk foot 161, and returns to the permanent magnet 162 via the tubular case 163*b*. This enables a biased static magnetic field to be applied to the magnetostrictive element 151.

In the magnetostrictive actuator 103, the driving rod 103*a* is not supported by a bearing. This enables no problem about a friction of the driving rod 103*a* with the bearing to arise, thereby reducing loss of the displacement output substantially.

In the magnetostrictive actuator 103, the magnetic force of pull-in allows a pre-load to be applied against the magnetostrictive element 151. This allows the pre-load to keep being stably applied thereto even if a period of the displacement by the magnetostrictive element 151 is short, thereby obtaining a proper displacement output based on the control current supplied to the solenoid coil 152.

Thus, in the magnetostrictive actuator 103, a relationship between the control current flown through the solenoid coil 152 and the displacement of the driving rod 103*a* comes closer to a linear one. This enables any distortion generated based on a characteristic of the magnetostrictive actuator 103 to be decreased, thereby reducing a burden of feedback adjustment.

In the magnetostrictive actuator 103, the permanent magnet 162 stands between two tubular cases 163*a*, 163*b* so that the biased static magnetic field can be more uniformly applied to the magnetostrictive element 151 as compared by a case where the permanent magnet is installed on a position of the fixed disk foot 161. In this embodiment, it is not necessary to provide any bearing for supporting the driving rod 103*a*, any coupling member for coupling the driving rod 103*a* to the container 154, any spring for applying a pre-load to the magnetostrictive element 151, and the like, thereby downsizing the magnetostrictive actuator 103 easily and manufacturing it at a low price.

The pipe member 102 and each of the magnetostrictive actuators 103 constitute a speaker component for high range of an audio frequency band to act as a tweeter. The speaker unit 104 constitutes a speaker component for low range of the audio frequency band to act as a woofer.

The speaker unit 104 is installed on the base casing 101 by using screws, not shown, with its front side being put upside down and closing the opening 105 at a lower end of the base casing 101.

In this embodiment, the speaker unit 104 is arranged so that it can be put on the same axis as that of the pipe member 102. Sound wave of positive phase emitted from the front side of the speaker unit 104 is emitted to outside by passing through the bottom of the base casing 101. Sound wave of negative phase emitted from the back side of the speaker unit 104 is emitted from upper end of the pipe member 102 to outside by passing through the opening 105 and the pipe member 102. In this embodiment, the pipe member 102 acts as a resonator.

A damper member 116 made of rubber material is arranged between the lower end surface of the pipe member 102 and the top surface of the base casing 101. This prevents any vibration by the magnetostrictive actuators 103 from propagating to the base casing 101 through the pipe member 102 and enhances sealing by the pipe member 102 so that the pipe member 102 can act as the resonator excellently.

Figure 8:
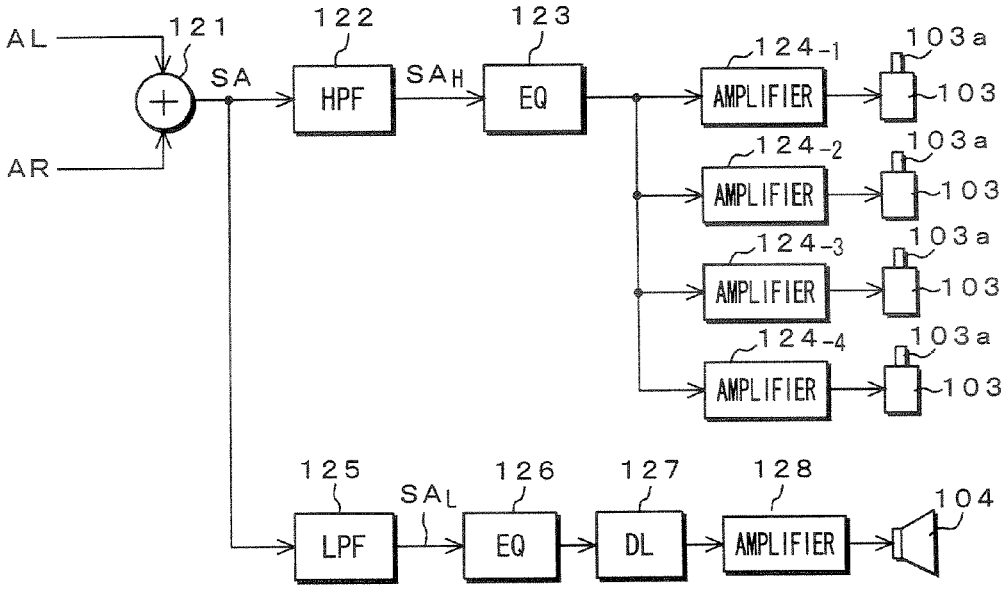
FIG. 8 is a block diagram for showing a configuration of a driving system for the magnetostrictive actuators and a speaker unit.

FIG. 8 shows a configuration of a driving system for the four magnetostrictive actuators 103 and the speaker unit 104.

Left component AL and right component AR of the acoustic signal, which constitute a stereo acoustic signal, are supplied to an adder 121. The adder adds these components AL, AR of the acoustic signal to each other to produce a monaural acoustic signal SA. A high-pass filter 122 receives the monaural acoustic signal SA and extracts its high range component SAH therefrom. An equalizer 123 receives this high range component SAH and adjusts its frequency characteristic so that it can correspond to the magnetostrictive actuators 103. Amplifiers 124-1 through 124-4 respectively receive and amplify the adjusted high range component SAH to supply it to the four magnetostrictive actuators 103 as the control signal therefor. This enables the four magnetostrictive actuators 103 to be driven by the same high range component SAH, so that their driving rods 103*a* can displace corresponding to the high range component SAH.

A low-pass filter 125 receives the monaural acoustic signal SA and extracts its low range component SAL therefrom. An equalizer 126 receives this low range component SAL and adjusts its frequency characteristic so that it can correspond to the resonator constituted of the pipe member 102. A delay circuit 127 receives and delays the adjusted low range component SAL by some milliseconds. An amplifier 128 receives and amplifies the delayed low range component SAL to supply it to the speaker unit 104 as the control signal therefor. This enables the speaker unit 104 to be driven by the low range component SAL.

Inserting the delay circuit 127 into a supply path of the low range component SAL to the speaker unit 104 enables to be delayed a point of time when sound wave of low range is emitted from the speaker unit 104 as compared by a point of time when sound wave of high range is emitted from the pipe member 102. This causes a listener to be liable to feel a sound image on the pipe member 102 that emits the sound wave of high range based on listening characteristic of human being such that a sound image is depended on a high range of the listened sound.

The following describe operations of the speaker 100A shown in FIGS. 2 through 5.

The four magnetostrictive actuators 103 contained and set in the base casing 101 are driven by the high range component SAH of the monaural acoustic signal SA. Their driving rods 103*a* displace corresponding to the high range component SAH. Based on the displacement of each of the driving rods 103*a*, the pipe member 102 vibrates by its component of the vibration orthogonal to the lower end surface of the pipe member 102 (along a plane of the pipe member 102).

The lower end surface of the pipe member 102 is excited by a longitudinal wave and an elastic wave (vibration) propagates to the pipe member 102 along the plane direction thereof. When this elastic wave propagates to the pipe member 102, the elastic wave repeats mode exchanges of a longitudinal wave to a transverse wave and vice versa, so that the longitudinal wave and the transverse wave can be mingled therein. The transverse wave excites vibration in a horizontal direction of the pipe member 102 (i.e., a direction orthogonal to the plane of the pipe member 102). This enables sound wave to be emitted from the pipe member 102 to an outside. In other words, an outer surface of the pipe member 102 can emit an acoustic output of high range that corresponds to the high range component SAH.

It is to be noted that, in this embodiment, the four magnetostrictive actuators 103 that are arranged in the base casing 101 at the same distance under and along a circular lower end surface of the pipe member 102 are driven based on the same high range component SAH of the monaural acoustic signal SA, so that a circumference of the pipe member 102 can emit an acoustic output of high range with omni-directionality.

The speaker unit 104 installed on the bottom of the base casing 101 is driven based on the low range component SAL of the monaural acoustic signal SA. The front surface of the speaker unit 104 emits an acoustic output of low range (positive phase), so that this acoustic output can be emitted from the bottom of the base casing 101 to outside. Further, the back surface of the speaker unit 104 emits an acoustic output of low range (negative phase), so that this acoustic output can be emitted from the top of the pipe member 102 to outside through the opening 105 and the pipe member 102.

According to the speaker 100A shown in FIGS. 2 through 5, the magnetostrictive actuators 103 driven based on the high range component SAH of the monaural acoustic signal SA vibrate with the lower end surface of the pipe member 102 by their component of vibration orthogonal to the lower end surface of the pipe member 102. This prevents large transverse wave from occurring at a vibration point. Therefore, a listener does not listen to sound wave from the vibration point being sounded very loud, as compared by that from another position, so that an acoustic image can be created over a whole of the pipe member 102 in its longitudinal direction. This causes a global acoustic image to be obtained.

The following describe simulations wherein a constant acceleration is input and an output is shown as the acceleration if the pipe member 102 vibrates at the lower end surface thereof in an axial direction thereof (case 1) and if the pipe member 102 vibrates at the lower end surface thereof in a radial direction thereof (case 2). In these simulations, it is supposed that the pipe member 102, made of acrylic resin, having a length of 1000 mm, a diameter of 100 mm, and a thickness of 2 mm is used.

Figure 9:
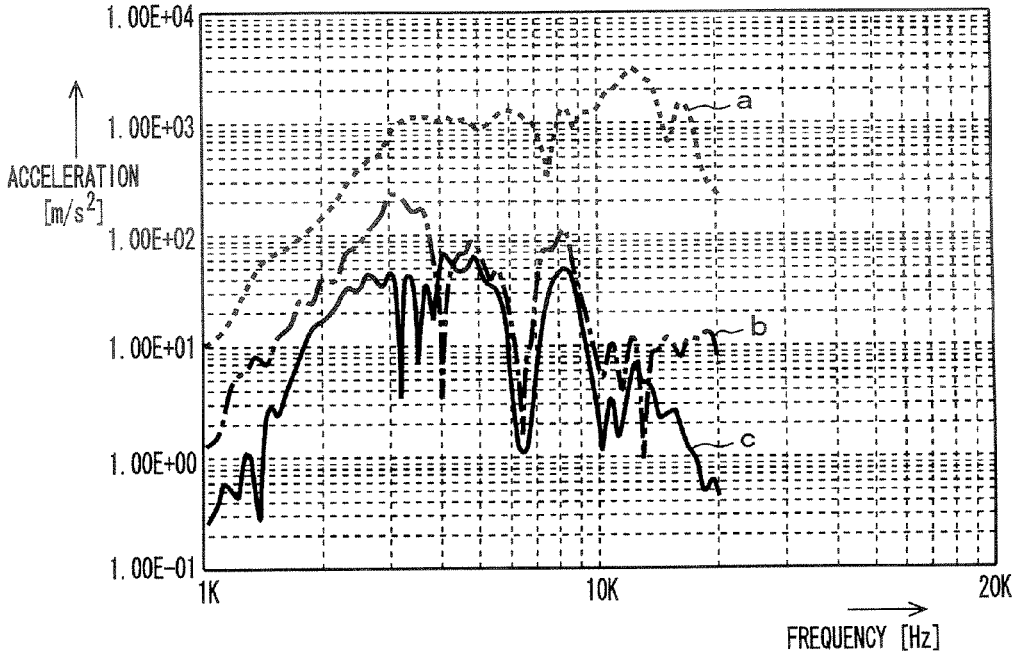
FIG. 9 is a graph for showing a result of a simulation of frequency response at each of the bottom position, the center position, and the top position of a pipe member when the pipe member vibrates in its radial direction.
Figure 10:
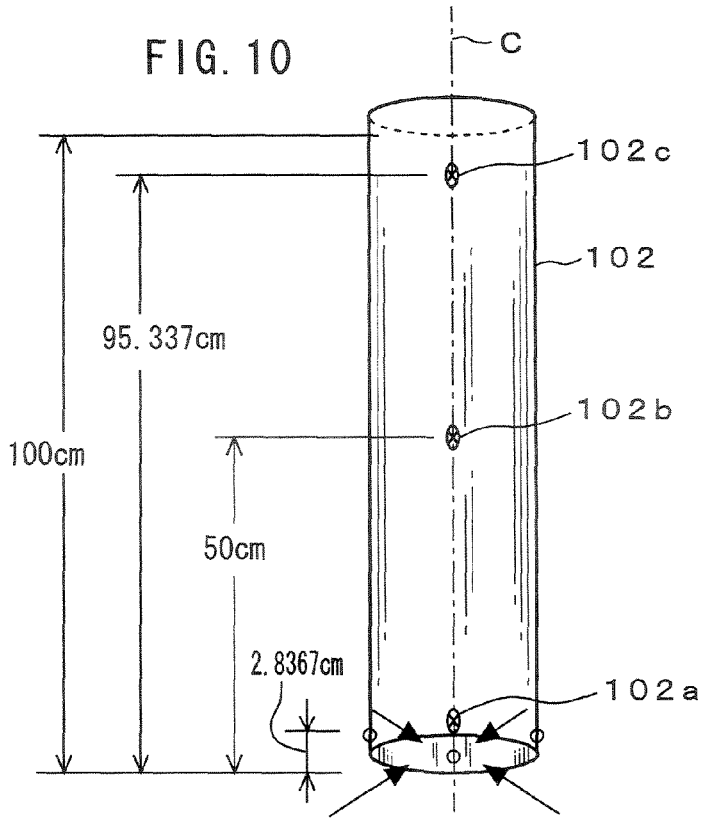
FIG. 10 is a diagram for illustrating a vibration direction when the pipe member vibrates in its radial direction.

FIG. 9 shows a result of the simulation when the pipe member 102 vibrates in its radial direction, as indicated by arrows of FIG. 10. A curve "a" indicates a frequency response at a bottom position 102*a* of the pipe member 102 that is positioned on a center axis C away from the lower end surface of the pipe member 102 by 2.8367 cm; a curve "b" indicates a frequency response at a center position 102*b* of the pipe member 102 that is positioned on the center axis C away from the lower end surface of the pipe member 102 by 50 cm; and a curve "c" indicates a frequency response at a top position 102*c* of the pipe member 102 that is positioned on the center axis C away from the lower end surface of the pipe member 102 by 95.337 cm.

If the pipe member 102 vibrates in its radial direction, a large transverse wave occurs at a vibration point. Therefore, a listener can listen to sound wave from the vibration point being sounded very loud, as compared by that from another position, so that a difference between the accelerations (sound pressure) at the positions can be made relatively large. This causes the listener to feel any uneven sound pressures at the positions of the pipe member 102 in its longitudinal direction. This prevents a global acoustic image from being obtained.

Figure 11:
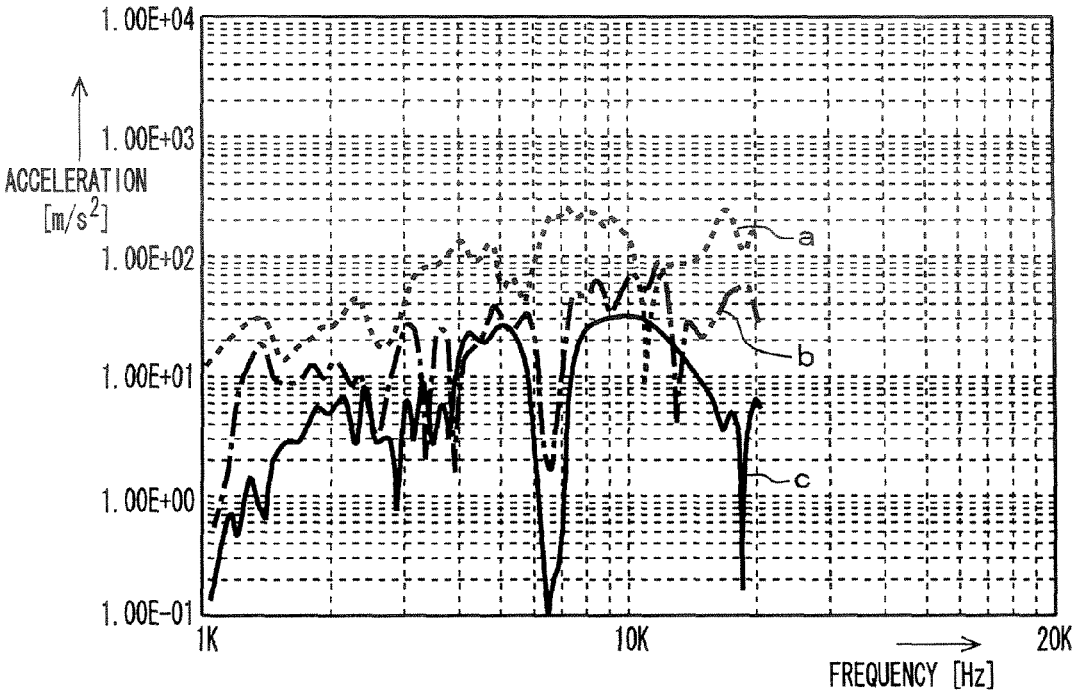
FIG. 11 is a graph for showing a result of a simulation of frequency response at each of the bottom position, the center position, and the top position of a pipe member when the pipe member vibrates in its axial direction.
Figure 12:
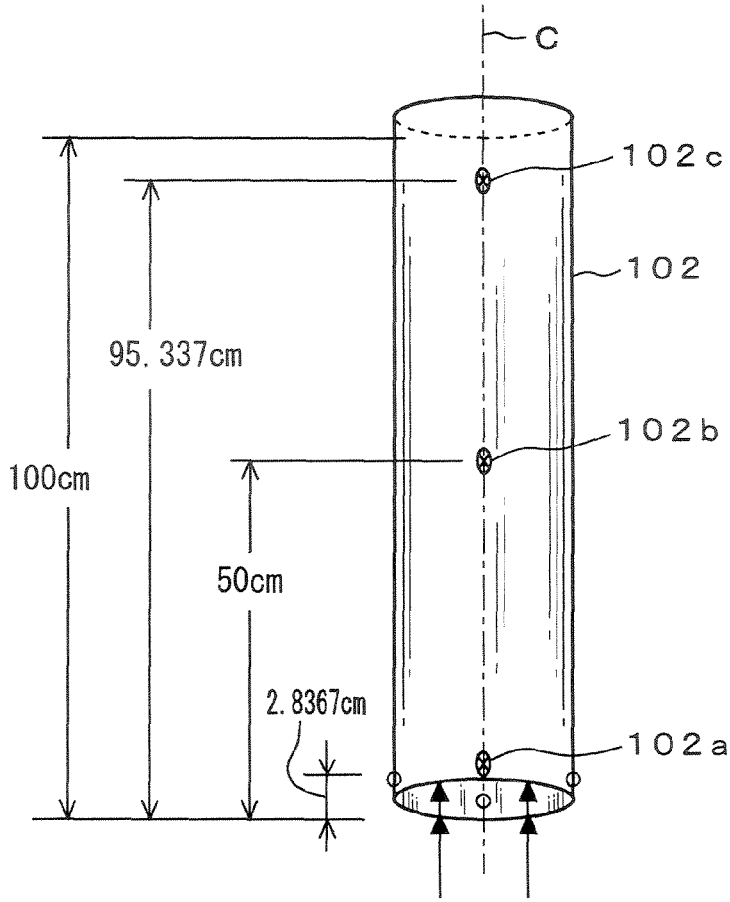
FIG. 12 is a diagram for illustrating a vibration direction when the pipe member vibrates in its axial direction.

FIG. 11 shows a result of the simulation when the pipe member 102 vibrates in its axial direction, as indicated by arrows of FIG. 12. A curve "a" indicates a frequency response at a bottom position 102*a* of the pipe member 102 that is positioned on a center axis C away from the lower end surface of the pipe member 102 by 2.8367 cm; a curve "b" indicates a frequency response at a center position 102*b* of the pipe member 102 that is positioned on the center axis C away from the lower end surface of the pipe member 102 by 50 cm; and a curve "c" indicates a frequency response at a top position 102*c* of the pipe member 102 that is positioned on the center axis C away from the lower end surface of the pipe member 102 by 95.337 cm.

If the pipe member 102 vibrates in its axial direction (a direction orthogonal to the lower end surface of the pipe member 102), no large transverse wave occurs at a vibration point. Therefore, a listener does not listen to sound wave from the vibration point being sounded very loud, as compared by that from another position, so that a difference between the accelerations (sound pressure) at the positions can be made relatively small. This causes the listener to feel any even sound pressures at the positions of the pipe member 102 in its longitudinal direction. This allows a global acoustic image to be obtained.

According to the speaker 100A shown in FIGS. 2 through 5, the magnetostrictive actuators 103 vibrate with the lower end surface of the pipe member 102, so that sound wave can be emitted from the positions of the pipe member 102 in its longitudinal direction. This enables acoustic output of high range corresponding to the high range component SAH of the monaural acoustic signal SA to be emitted from an outer surface of the pipe member 102. Therefore, in this speaker 100A, any driving device such as the magnetostrictive actuator is not present at a position of the pipe member 102 wherein sound image is created, so that if the pipe member 102 is made of complete transparent material, no driving device is seen. Thus, it is possible to display any visual information, for example, to the accompaniment of emitted sound on the pipe member 102 without being interrupted with the driving device.

According to the speaker 100A shown in FIGS. 2 through 5, an acoustic output of low range (positive phase) emitted from the front surface of the speaker unit 104 attached on the bottom of the base casing 101 can be emitted from the bottom of the base casing 101 to outside and the acoustic output of low range (negative phase) emitted from the back surface of the speaker unit 104 can be emitted from the top of the pipe member 102 to outside through the opening 105 and the pipe member 102. This enables the listener to feel any even sound pressures relative to the acoustic output of low range at the positions of the pipe member 102 in its longitudinal direction, thereby creating the sound image over a whole of the pipe member 102 in its longitudinal direction, to obtain a global acoustic image.

Sound pressure levels (SPL) at a top position M1 and a bottom position M2, which are respectively away from each of the upper portion and the lower portion of the pipe member 102 by one meter, in the following measurements (1) and (2) were measured using microphones: The measurement (1) relates to a case where sound wave SW is emitted from only the top of the pipe member 102 and the measurement (2) relates to a case where sound wave SW is emitted from both of the top and the bottom of the pipe member 102.

Figure 13:
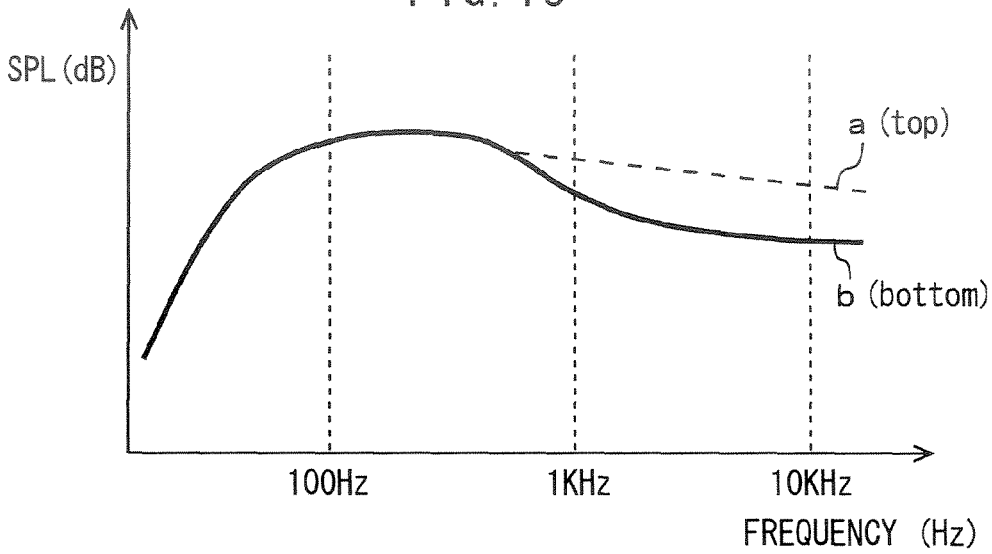
FIG. 13 is a graph for showing a result of a sound pressure level (SPL) measurement at each of the bottom position and the top position of a pipe member when sound wave is emitted from only the top of the pipe member.
Figure 14:
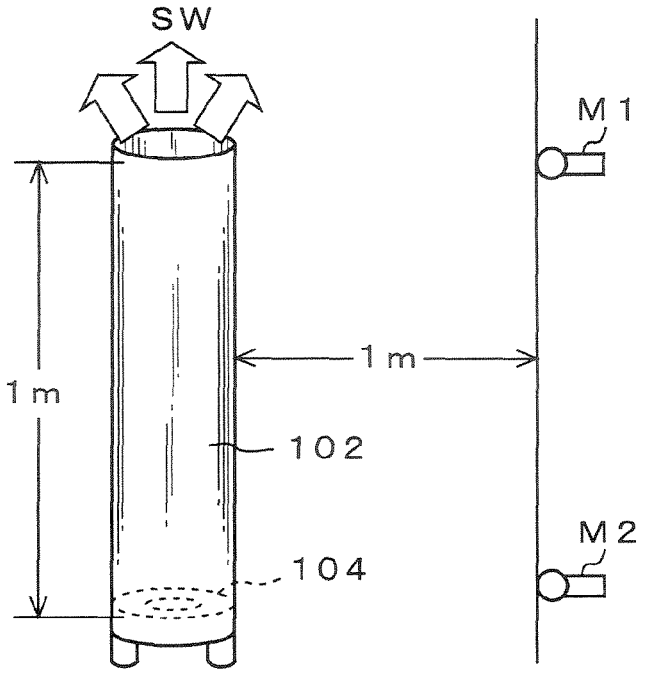
FIG. 14 is a diagram for illustrating an emission direction of the sound wave and positions to be measured when sound wave is emitted from only the top of the pipe member.

FIG. 13 shows a result of the measurement (1) when the sound wave SW is emitted from only the top of the pipe member 102, as indicated by arrows of FIG. 14. A curve "a" indicates SPL at a top position M1 and a curve "b" indicates SPL at a bottom position M2. As shown in FIG. 13, when the sound wave SW is emitted from only the top of the pipe member 102, SPL at the bottom position M2 is lower than that at the top position M1. This prevents the listener from feeling any even sound pressure relative to the acoustic output of low range over a whole of the pipe member 102 in its longitudinal direction.

Figure 15:
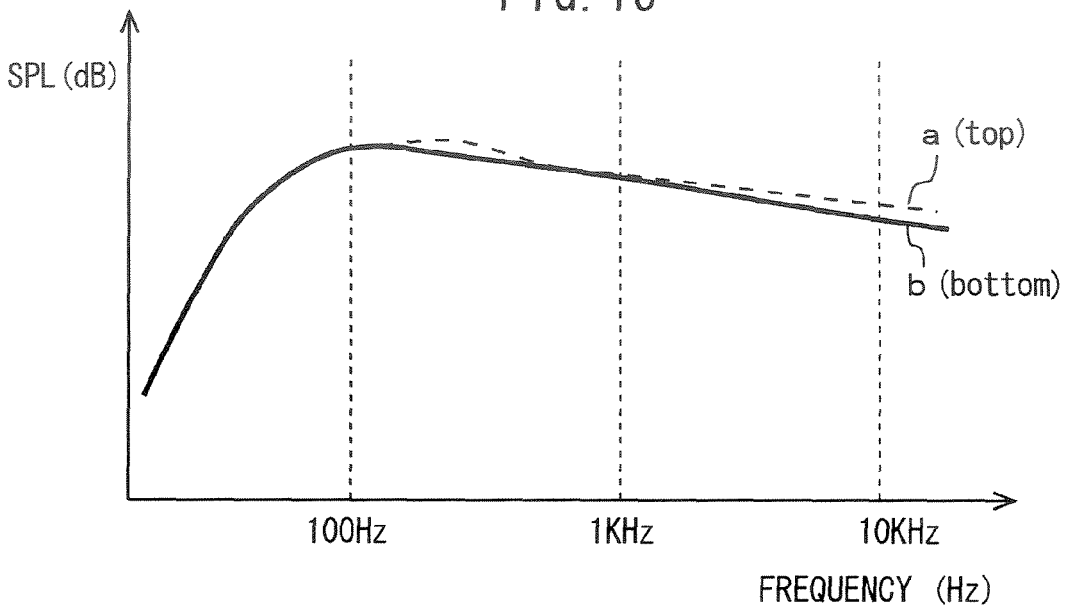
FIG. 15 is a graph for showing a result of the SPL measurement at each of the bottom position and the top position of a pipe member when sound wave is emitted from both of the top and the bottom of the pipe member.
Figure 16:
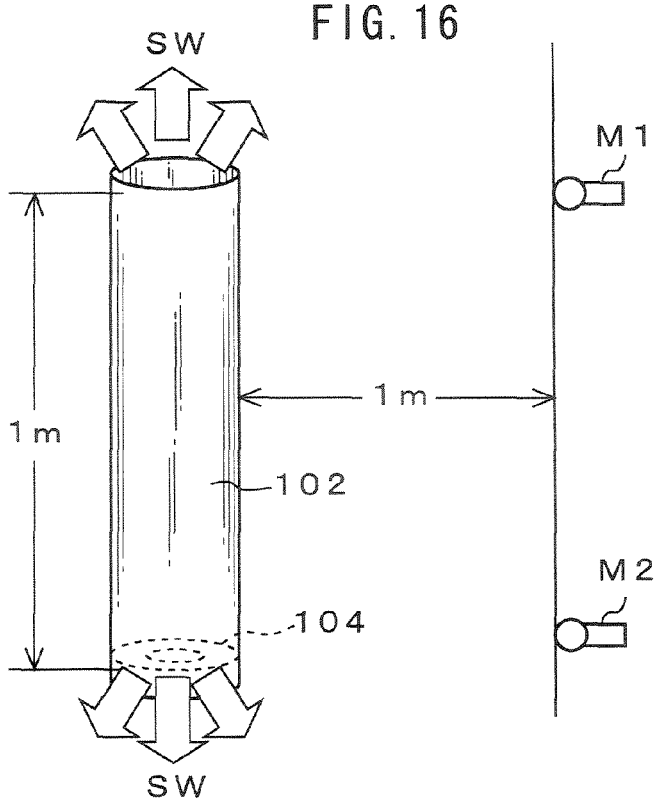
FIG. 16 is a diagram for illustrating an emission direction of the sound wave and positions to be measured when sound wave is emitted from both of the top and the bottom of the pipe member.

FIG. 15 shows a result of the measurement (2) when the sound wave SW is emitted from both of the top and the bottom of the pipe member 102, as indicated by arrows of FIG. 16. A curve "a" indicates SPL at a top position M1 and a curve "b" indicates SPL at a bottom position M2. As shown in FIG. 15, when the sound wave SW is emitted from both of the top and the bottom of the pipe member 102, SPL at the bottom position M2 is almost equal to that at the top position M1. This allows the listener to feel any even sound pressure relative to the acoustic output of low range over a whole of the pipe member 102 in its longitudinal direction.

The driving system for the magnetostrictive actuators 103 and the speaker unit 104 has been described so that its configuration can be become that shown in FIG. 8 and the four magnetostrictive actuators 103 can be driven by the same high range component SAH of the monaural no acoustic signal SA. According to an embodiment, however, these four magnetostrictive actuators 103 can be driven by the separate high range components SAH.

Figure 17:
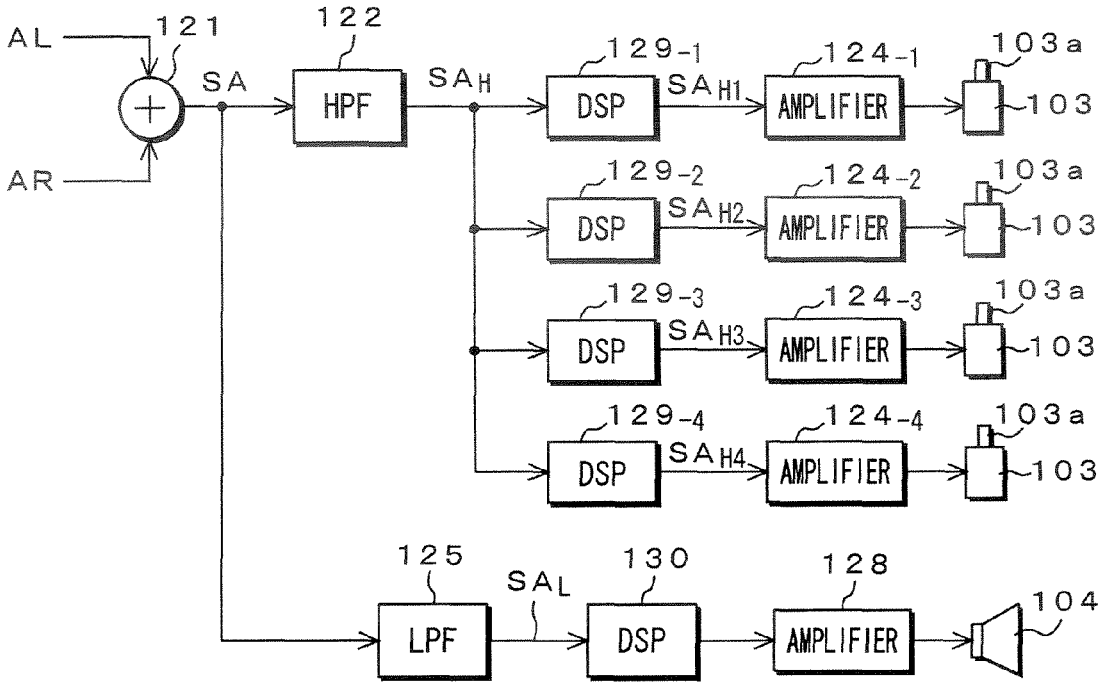
FIG. 17 is a block diagram for showing another configuration of a driving system for the magnetostrictive actuators and a speaker unit.

FIG. 17 shows another configuration of the driving system for the four magnetostrictive actuators 103 and the speaker unit 104. In FIG. 17, like reference numbers refer to like elements of FIG. 8, a detailed explanation of which will be omitted.

The high range component SAH of the monaural acoustic signal SA extracted by a high pass filter (HPF) 122 is supplied to four digital signal processors (DSP) 129-1 through 129-4. These four digital signal processors 129-1 through 129-4 respectively adjust the high range component SAH, separately, on its level, delay time, frequency characteristic and the like. Amplifiers 124-1 through 124-4 respectively receive the adjusted high range components SAH1 through SAH4 from the four digital signal processors 129-1 through 129-4 and amplify them. Four magnetostrictive actuators 103 then receive the amplified high range components SAH1 through SAH4, respectively, as the driving signals therefor. Thus, these four magnetostrictive actuators 103 are respectively driven based on the separate high range components SAH1 through SAH4, thereby enabling these magnetostrictive actuators 103 to be separately displaced based on the high range components SAH1 through SAH4.

The low range component SAL of the monaural acoustic signal SA extracted by a low pass filter (LPF) 125 is supplied to a DSP 130. The DSP 130 performs any processing corresponding to, for example, those performed in the equalizer 126 and the delay circuit 127 shown in FIG. 8. An amplifier 128 receives the low range component SAL from the DSP 130 and amplifies it. Speaker unit 104 then receives the amplified low range component SAL as the driving signal therefor. Thus, the speaker unit 104 is driven based on the low range component SAL.

According to the configuration of the driving system shown in FIG. 17, these four magnetostrictive actuators 103 are respectively driven based on the high range components SAH1 through SAH4, which are separately obtained by processing in the DSPS 129-1 through 129-4, so that it is possible to process a sound field in order to enhance a global acoustic image.

It is to be noted that although, in the configuration of the driving system shown in FIG. 17, the high range components SAH1 through SAH4 for driving the four magnetostrictive actuators 103 have been extracted from the monaural acoustic signal SA, in an embodiment of the invention, they can be extracted from the left acoustic signal AL and the right acoustic signal AR, which constitute a stereo acoustic signal, or from multi-channel acoustic signal.

Figure 18:
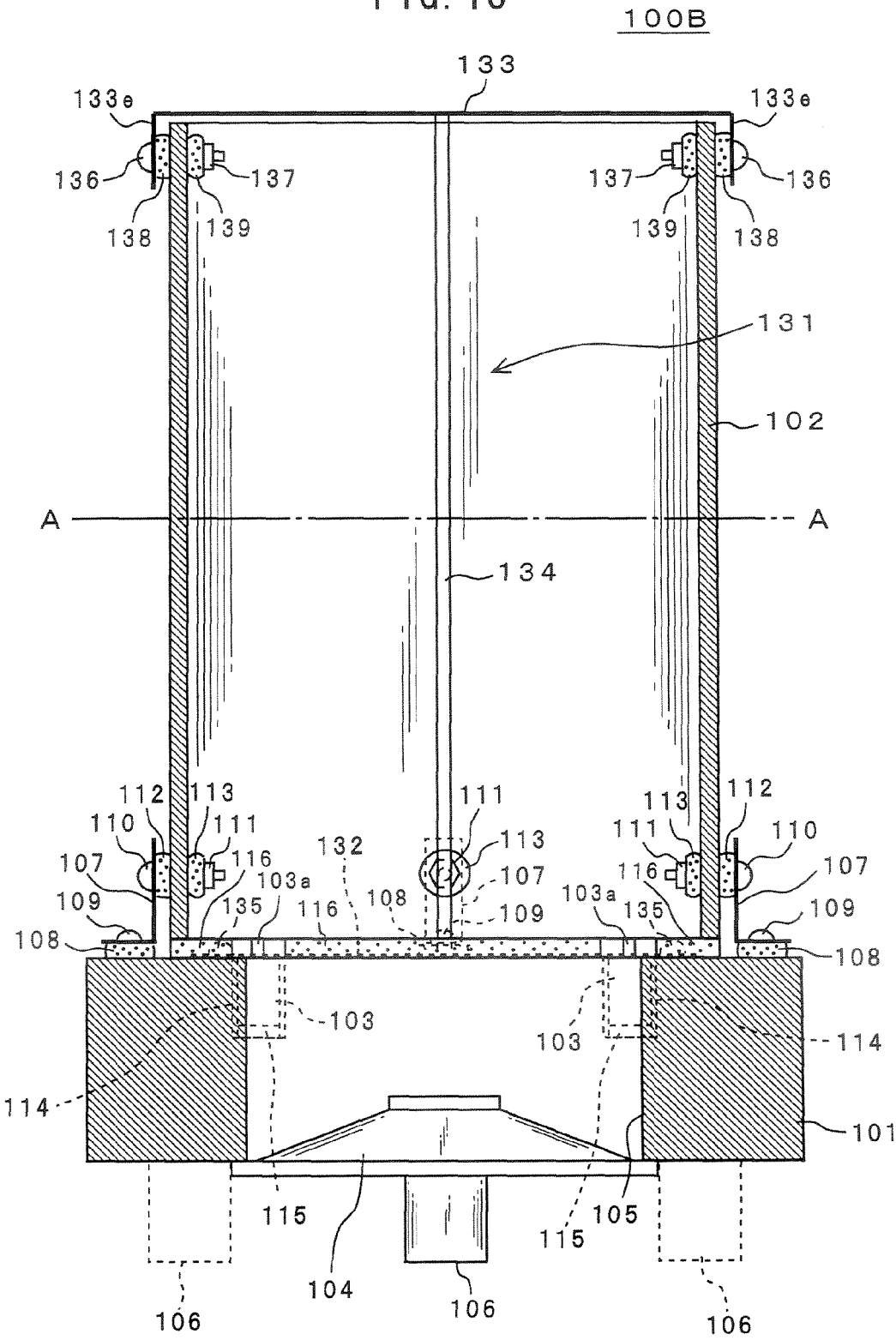
FIG. 18 is a vertical sectional view of the speaker 100B according to another embodiment of the invention.
Figure 19:
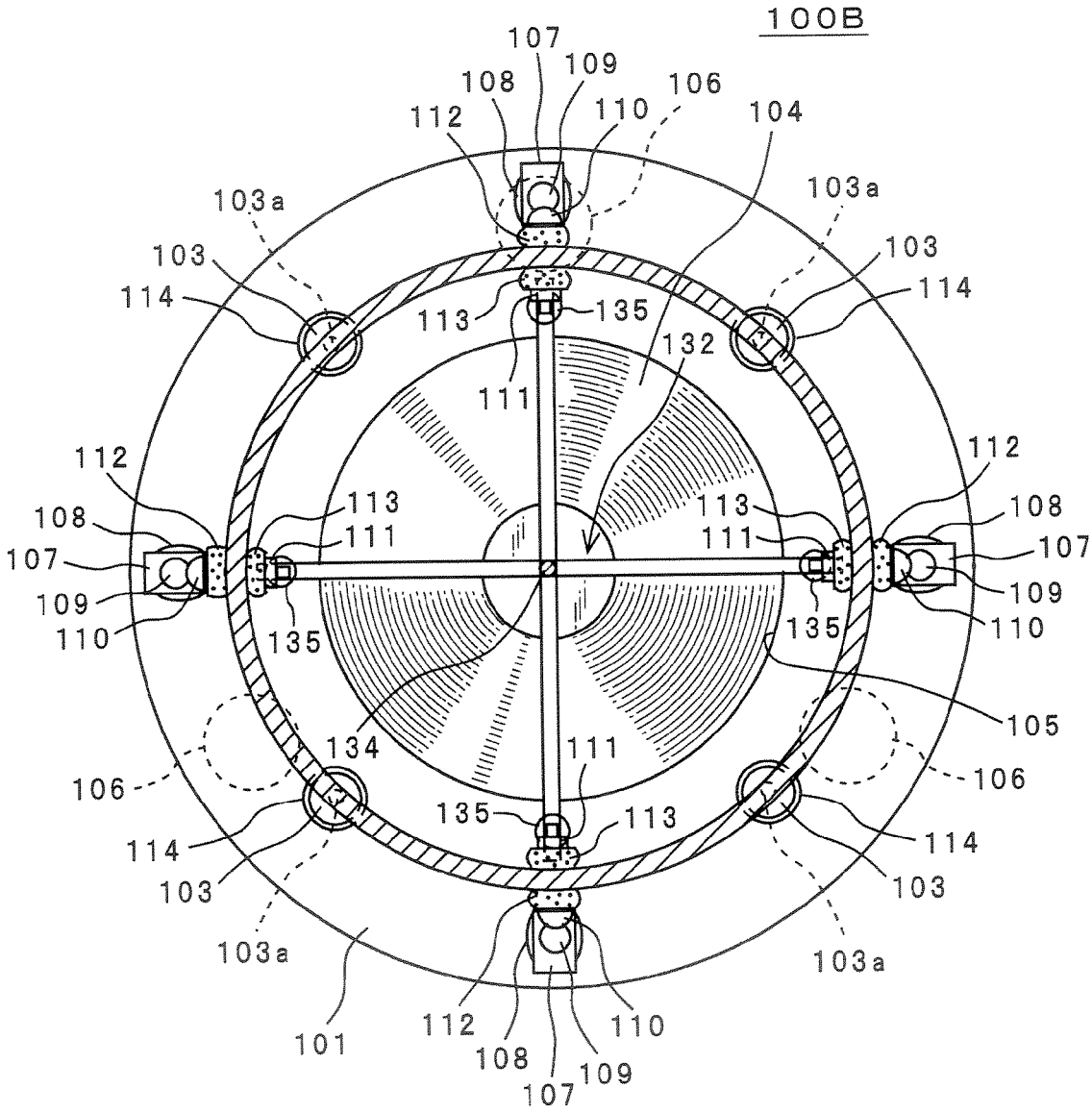
FIG. 19 is a traverse sectional view of the speaker 100B according to the another embodiment of the invention.
Figure 20:
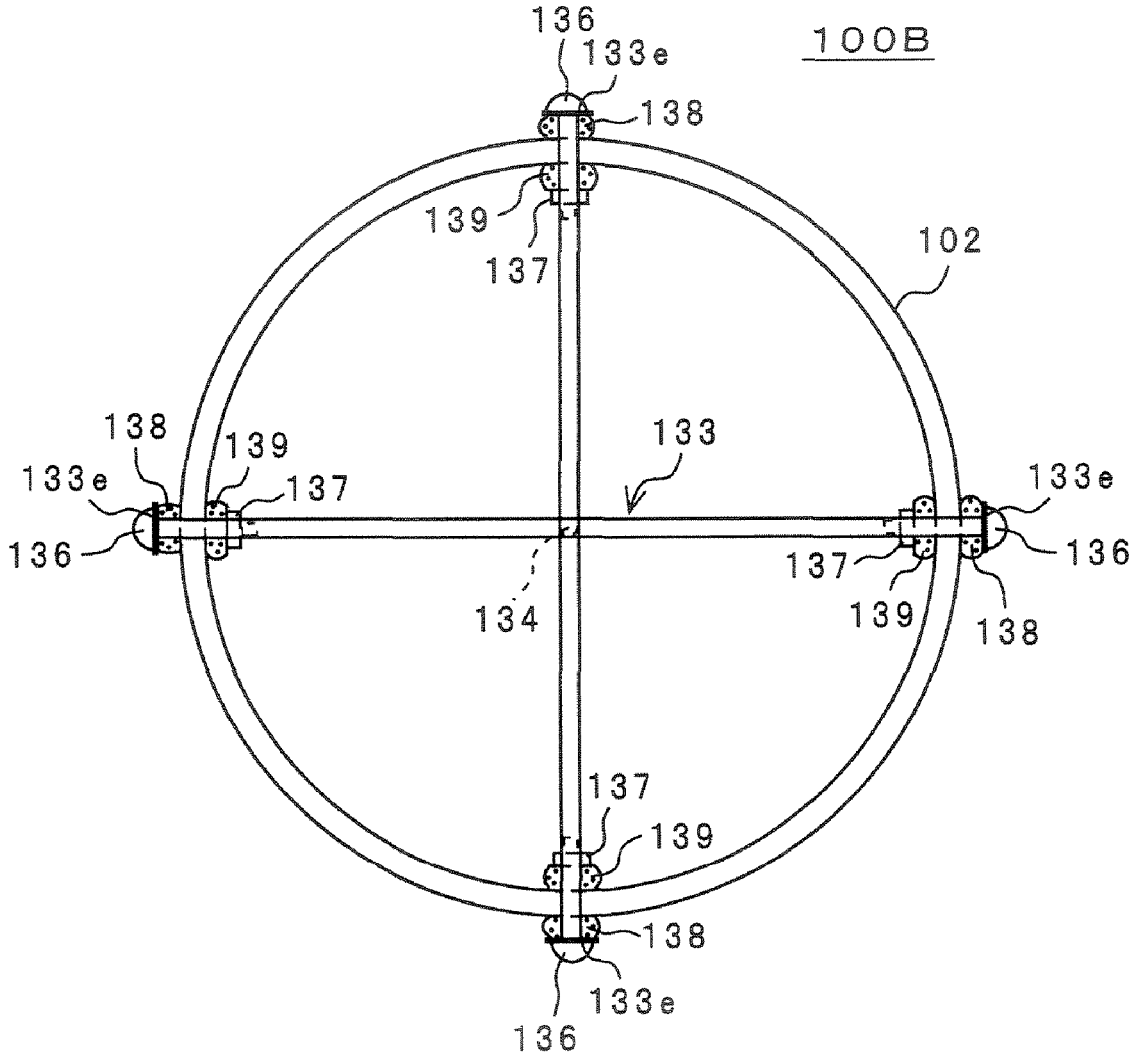
FIG. 20 is a partially omitted top plan view of the speaker 100B according to the another embodiment of the invention.

The following will describe a speaker 100B according to another embodiment of the invention. FIGS. 18 through 20 show a configuration of the speaker 100B according to this another embodiment of the invention. FIG. 18 shows a vertical sectional view of the speaker 100B; FIG. 19 is a traverse sectional view of the speaker 100B, a lower portion of which is clearly shown taken along the lines A-A shown in FIG. 18; and FIG. 20 is a top plan view of the speaker 100B (a lower portion of which is shown taken along the lines A-A shown in FIG. 18 will be partially omitted). In FIGS. 18 through 20, like reference numbers refer to like elements of FIGS. 2 through 5, a detailed explanation of which will be omitted.

The speaker 100B has a supporting member 131 that supports the pipe member 102, in addition to the configuration of the speaker 100A shown in FIGS. 2 through 5. The supporting member 131 has lower crossed bars 132 to be set on the top surface of the base casing 101, upper crossed bars 133 to be set on the top of the pipe member 102, and a rod 134. An end of the rod 134 is connected to a center of the lower crossed bars 132 and the other end thereof is connected to a center of the upper crossed bars 133.

Four ends of the lower crossed bars 132 respectively have round holes for screws, not shown. The four ends thereof are respectively secured to the top surface of the base casing 101 by screws 135. Each screw hole, not shown, to which a screw thread of each of the screws 135 is secured is formed in the base casing 101.

Four ends 133*e* of the upper crossed bars 133 respectively are made wide and fold down at right angles. These four ends 133*e* respectively have round holes for screws, not shown. The four ends 133*e* of the upper crossed bars 133 are respectively secured to the top portion of the pipe member 102 by screws 136 and nuts 137. Each screw hole, not shown, to which a screw thread of the screw 136 is secured is formed in the top portion of the pipe member 102.

Damper members 138, 139 each constituted of ring-shaped rubber member stand between each of the four ends 133*e* of the upper crossed bars 133 and the outer surface of the pipe member 102 and between each of the nuts 137 and the inner surface of the pipe member 102. This prevents the vibration (elastic wave) by the magnetostrictive actuators 103 from propagating to the base casing 101 through the pipe member 102 and the supporting member 131.

Remaining parts of the speaker 100B shown in FIGS. 18 through 20 is similar to those of the speaker 100A shown in FIGS. 2 through 5. The speaker 100B shown in FIGS. 18 through 20 operates similar to the operations of the speaker 100A shown in FIGS. 2 through 5.

According to the speaker 100B, it can attain the excellent effects similar to those of the speaker 100A as well as since the supporting member 131 supports the pipe member 102, it can secure its equilibrium if the pipe member 102 is elongated. The supporting member 131 is made of the rod 134 and the like as described above so that its occupied capacity in the pipe member is made small, which has little influence on any function of the pipe member 102 as a resonator.

Figure 21:
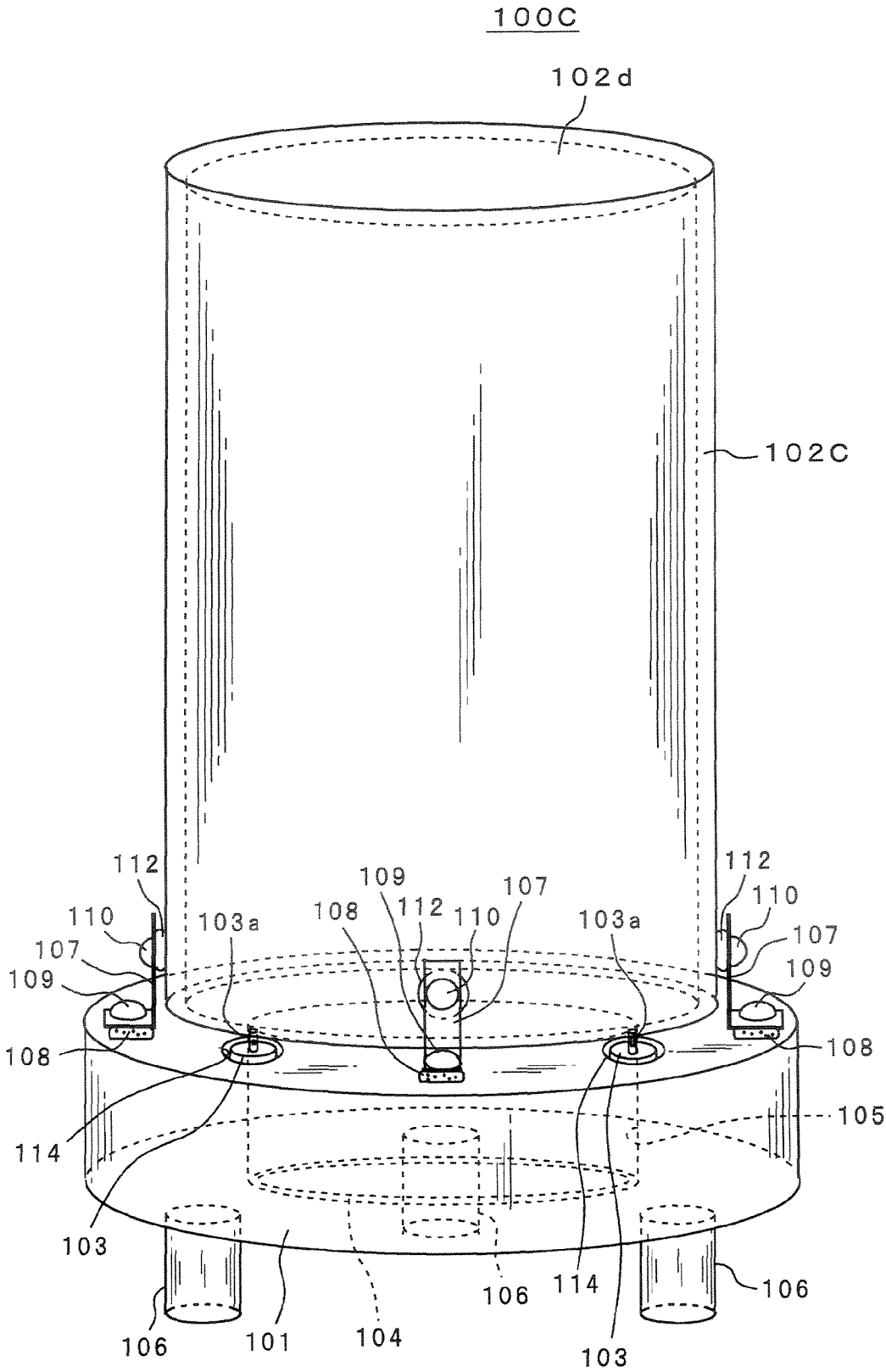
FIG. 21 is a perspective view of a speaker 100C according to further embodiment of the invention.

The following will describe a speaker 100C according to further embodiment of the invention. FIG. 21 shows a configuration of the speaker 100C according to the further embodiment of the invention. FIG. 21 shows a perspective view of the speaker 100C. In FIG. 21, like reference numbers refer to like elements of FIG. 2, a detailed explanation of which will be omitted.

In this speaker 100C, a cup member 102C that is a pipe member having a bottom is used in place of the pipe member 102 of the speaker 100A shown in FIG. 2. This cup member 102C is set upside down on the top surface of the base casing 101 with an upper portion thereof being closed by a bottom 102*d* and a lower portion thereof being opened. How to set this cup member 102C is similar to that of the pipe member 102, a detailed explanation of which will be omitted.

The driving rods 103*a* of the magnetostrictive actuators 103 set in the base casing 101 are respectively attached to a lower end surface of the cup member 102C. This enables the cup member 102C to vibrate by the magnetostrictive actuators 103, similar to the above-mentioned pipe member 102, by their component of vibration orthogonal to the lower end surface of the cup member 102C from the lower end surface thereof.

It is to be noted that in this speaker 100C, no damper member as the speaker 100A shown in FIG. 2 stands between the lower end surface of the cup member 102C and the base casing 101. This is because the cup member 102C has no function as a resonator for the reason that the upper portion thereof is closed by the bottom 102*d* so that it is not necessary to enhance its sealing as the resonator.

Remaining parts of the speaker 100C shown in FIG. 21 is similar to those of the speaker 100A shown in FIG. 2. The speaker 100C shown in FIG. 21 operates similar to the operations of the speaker 100A shown in FIG. 2 except if the cup member 102C has no function as the resonator.

According to the speaker 100C, the magnetostrictive actuators 103 driven based on the high range component SAH of the monaural acoustic signal SA vibrate with the lower end surface of the cup member 102C by their component of vibration orthogonal to the lower end surface of the cup member 102C. This prevents large transverse wave from occurring at a vibration point. Therefore, a listener does not listen to sound wave from the vibration point being sounded very loud, as compared by that from another position, so that an acoustic image can be created over a whole of the cup member 102C in its longitudinal direction. This causes a global acoustic image to be obtained.

Since, according to the speaker 100C, the upper portion of the cup member 102C is closed by the bottom 102*d*, any vibration (elastic wave) by the magnetostrictive actuators 103 can propagate up to this bottom 102*d* so that the bottom 102*d* can also emit sound wave to outside, thereby enhancing the global acoustic image.

Figure 22:
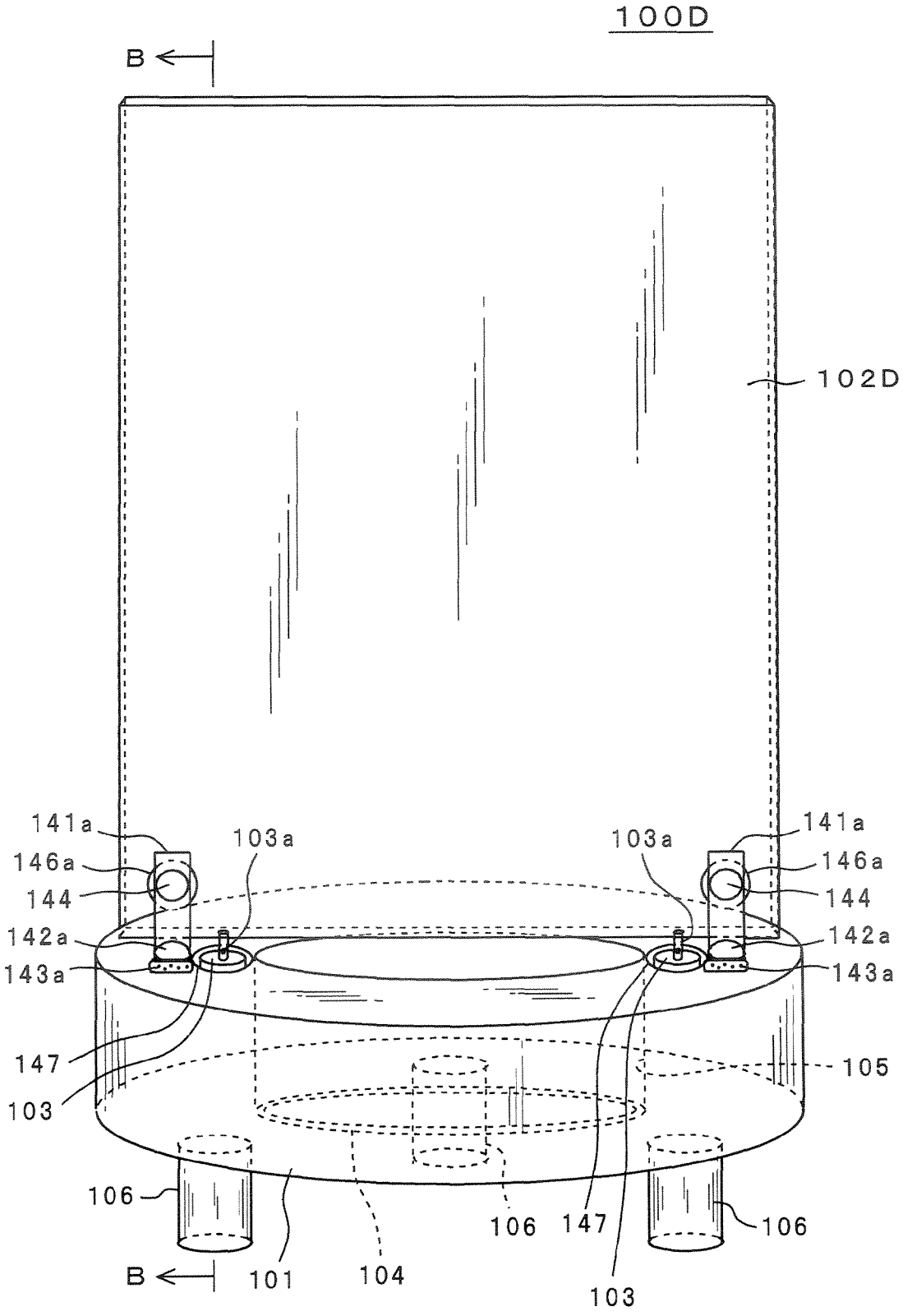
FIG. 22 is a perspective view of a speaker 100D according to additional embodiment of the invention.
Figure 23:
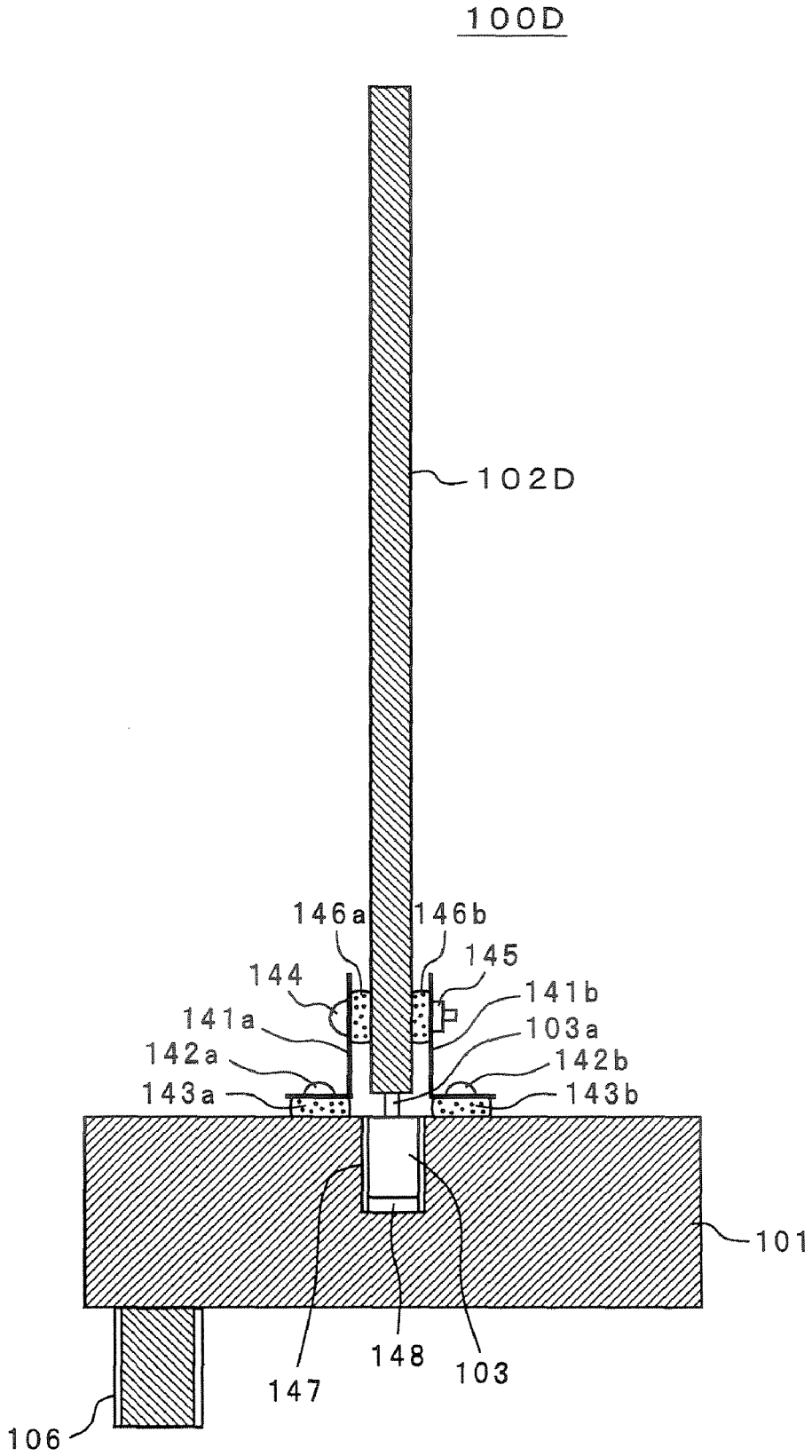
FIG. 23 is a vertical sectional view of the speaker 100D according to the additional embodiment of the invention.

The following will describe a speaker 100D according to additional embodiment of the invention. FIGS. 22 and 23 show a configuration of the speaker 100D according to the additional embodiment of the invention. FIG. 22 is a perspective view of the speaker 100D and FIG. 23 is a vertical sectional view of the speaker 100D taken along the lines B-B shown in FIG. 22. In FIGS. 22 and 23, like reference numbers refer to like elements of FIGS. 2 and 3, a detailed explanation of which will be omitted.

Although the pipe member 102 has been used as the acoustic diaphragm with a tube shape in the speaker 100A shown in FIGS. 2 and 3, a rectangular acrylic plate 102D is used as the acoustic diaphragm with a plate shape in the speaker 100D according to this embodiment of the invention.

This acrylic plate 102D is set on the base casing 101. Namely, a lower end portion of the acrylic plate 102D is set on a top surface of the base casing 101 at a plurality of positions, in this embodiment, two positions by using two L-shaped metal angles 141*a*, and 141*b*.

In both ends of each of the L-shaped metal angles 141*a*, 141*b*, round holes for a screw, not shown, are respectively bored. An end of each of the L-shaped angles 141*a*, 141*b* is screwed to the top surface of the base casing 101 by a screw 142*a* or 142*b*. Each screw hole, not shown, to which a screw thread of each of the screws 142*a*, 142*b* is secured is formed in the base casing 101. The ends of the L-shaped angles 141*a*, 141*b* are respectively screwed to the top surface of the base casing 101 through damper members 143*a*, 143*b* each constituted of ring-shaped rubber member.

The other ends of the L-shaped angles 141*a*, 141*b* are secured to a lower end portion of the acrylic plate 102D by screws 144 and nuts 145. Each screw hole, not shown, to which a screw thread of each of the screws 144 is secured is formed in the lower end portion of the acrylic plate 102D. It is to be noted that the L-shaped angles 141*a* are positioned at one side of the acrylic plate 102D while the L-shaped angles 141*b* are positioned at the other side of the acrylic plate 102D. Damper members 146*a*, 146*b* each constituted of ring-shaped rubber member stand between the other end of the L-shaped angle 141*a* and a side surface of the acrylic plate 102D and between the other end of the L-shaped angle 141*b* and the other side surface of the acrylic plate 102D.

The damper members 143*a*, 143*b*, 146*a*, and 146*b* thus intervened prevent any vibration (elastic wave) by the magnetostrictive actuators 103 from propagating to the base casing 101 thorough the acrylic plate 102D and the L-shaped angles 141*a*, 141*b*, thereby avoiding localizing any sound image to the base casing 101.

Plural magnetostrictive actuators 103, in this embodiment, two magnetostrictive actuators are set in the base casing 101. These two magnetostrictive actuators 103 are positioned under and along a lower end surface of the acrylic plate 102D. On the top surface of the base casing 101, hollows 147 each for containing the magnetostrictive actuator 103 are formed. The magnetostrictive actuators 103 are respectively set on the base casing 101 with them being contained in the hollows 147.

Each of the magnetostrictive actuators 103 is set on a bottom of the hollow 147 in the base casing 101 through a damper member 148 constituted of ring-shaped rubber member. The damper member 148 thus intervened prevent any vibration by the magnetostrictive actuator 103 from propagating to the base casing 101, thereby avoiding localizing any sound image to the base casing 101.

When each of the magnetostrictive actuators 103 is set on the base casing 101 with them being contained in the hollows 147 thereof, the driving rod 103*a* of each of the magnetostrictive actuators 103 is attached to the lower end surface of the acrylic plate 102D. In this moment, a displacement direction of each of the driving rods 103*a* is oriented along a direction orthogonal to the lower end surface of the acrylic plate 102D, namely, a direction along a plane of the acrylic plate 102D. Such a configuration enables the magnetostrictive actuators

103 to vibrate with the lower end surface of the acrylic plate 102D by their component of the vibration that is orthogonal to the lower end surface of the acrylic plate 102D.

The two magnetostrictive actuators 103 are driven by the driving system, for example, one shown in FIG. 8 based on the same high range component SAH, so that their driving rods 103*a* can displace corresponding to the high range component SAH. Alternatively, these two magnetostrictive actuators 103 are respectively driven by the driving system, for example, one shown in FIG. 17 based on the separate high range components SAH1, SAH2, so that their driving rods 103*a* can displace corresponding to their corresponding high range components SAH1, SAH2, respectively.

The following describe operations of the speaker 100D shown in FIGS. 22 and 23.

The two magnetostrictive actuators 103 contained and set in the base casing 101 are driven by, for example, the high range component SAH of the monaural acoustic signal SA. Their driving rods 103*a* displace corresponding to the high range component SAH. Based on the displacement of each of the driving rods 103*a*, the magnetostrictive actuators 103 vibrate with the lower end surface of the acrylic plate 102D by their component of the vibration orthogonal.

The lower end surface of the acrylic plate 102D is excited by a longitudinal wave and an elastic wave (vibration) propagates to the plane direction of the acrylic plate 102D. When this elastic wave propagates to the acrylic plate 102D, the elastic wave repeats mode exchanges of a longitudinal wave to a transverse wave and vice versa, so that the longitudinal wave and the transverse wave can be mingled therein. The transverse wave excites vibration in a horizontal direction of the acrylic plate 102D (i.e., a direction orthogonal to the plane of the acrylic plate 102D). This enables sound wave to be emitted from both side surfaces of the acrylic plate 102D. In other words, an outer surface of the acrylic plate 102D can emit an acoustic output of high range that corresponds to the high range component SAH.

The speaker unit 104 installed on the bottom of the base casing 101 is driven based on the low range component SAL of the monaural acoustic signal SA. The front surface of the speaker unit 104 emits an acoustic output of low range (positive phase), so that this acoustic output can be emitted from the bottom of the base casing 101 to outside. Further, the back surface of the speaker unit 104 emits an acoustic output of low range (negative phase), so that this acoustic output can be emitted from the top surface of the base casing 101 to outside through the opening 105.

According to the speaker 100D shown in FIGS. 22 and 23, the magnetostrictive actuators 103 driven based on the high range component SAH of the monaural acoustic signal SA vibrate with the lower end surface of the acrylic plate 102D by their component of vibration orthogonal to the low end surface of the acrylic plate 102D. This prevents large transverse wave from occurring at a vibration point. Therefore, a listener does not listen to sound wave from the vibration point being sounded very loud, as compared by that from another position, so that an acoustic image can be created over whole surfaces of the acrylic plate 102D. This causes a global acoustic image to be obtained.

According to the speaker 100D shown in FIGS. 22 and 23, the magnetostrictive actuators 103 vibrate with the lower end surface of the acrylic plate 102D, so that sound wave can be emitted from the positions of the acrylic plate 102D in its longitudinal direction. This enables acoustic output of high range corresponding to the high range component SAH of the monaural acoustic signal SA to be emitted from the outer surfaces of the acrylic plate 102D. Therefore, in this speaker 100D, any driving device such as the magnetostrictive actuator is not present at a position of the acrylic plate 102D wherein sound image is created, so that if the acrylic plate 102D is made of complete transparent material, no driving device is seen. Thus, it is possible to display any visual information, for example, to the accompaniment of emitted sound on the acrylic plate 102D without being interrupted with the driving device.

Figure 24:
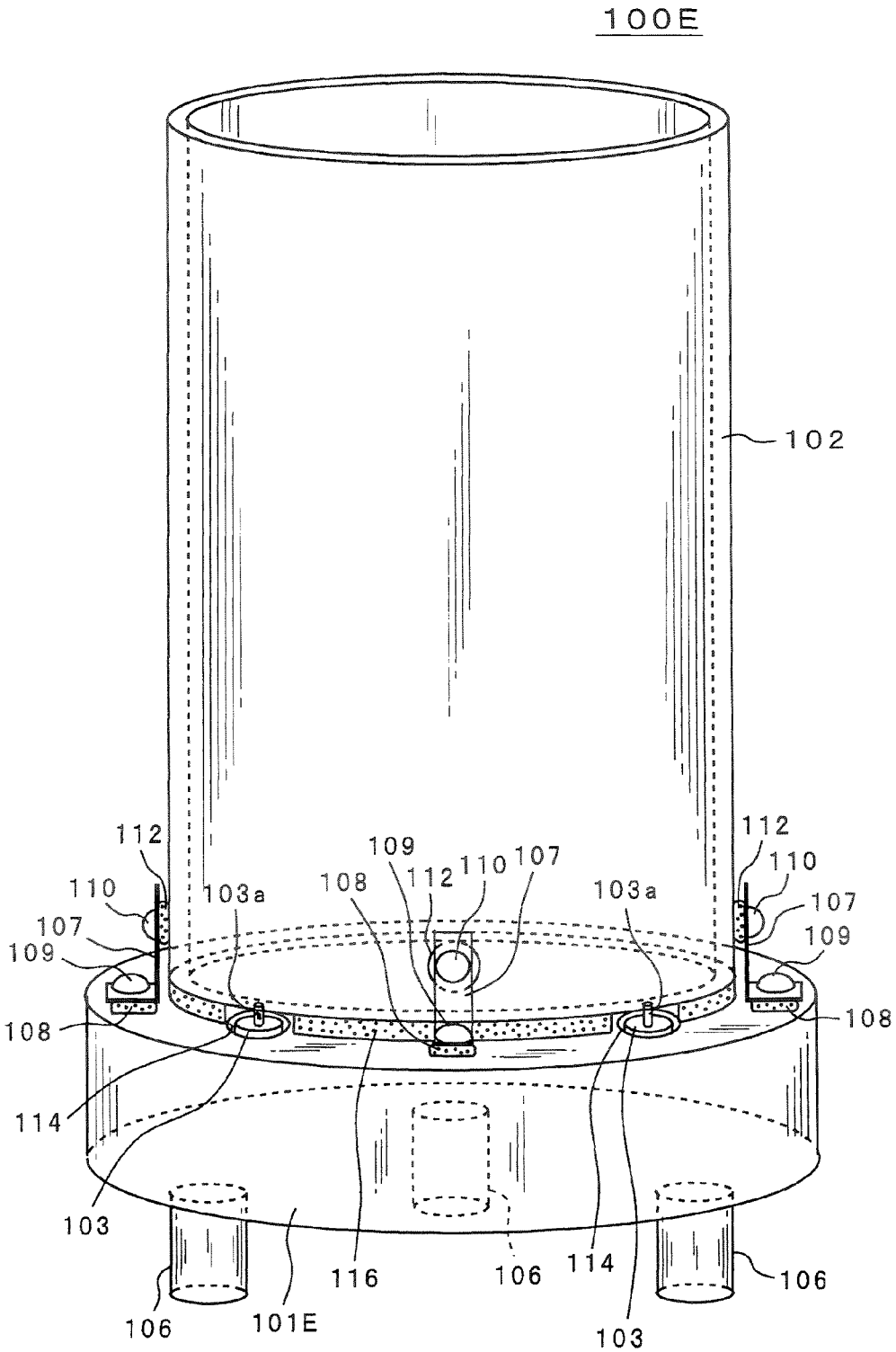
FIG. 24 is a perspective view of a speaker 100E according to a still another embodiment of the invention.

The following will describe a speaker 100E according to a still another embodiment of the invention. FIG. 24 shows a configuration of the speaker 100E according to the still another embodiment of the invention. FIG. 24 is a perspective view of the speaker 100E. In FIG. 24, like reference numbers refer to like elements of FIG. 2, a detailed explanation of which will be omitted.

In this speaker 100E, a disk-like base casing 101E having no opening is used in place of the base casing 101 of the speaker 100A shown in FIG. 2. The pipe member 102 is set on a top surface of the disk-like base casing 101E and four magnetostrictive actuators 103 (only two magnetostrictive actuators 103 are shown in this figure) are contained and set therein. How to set this pipe member 102 and the magnetostrictive actuators 103 is similar to that of the speaker 100A shown in FIG. 2, a detailed explanation of which will be omitted.

It is to be noted that in this speaker 100E, no speaker unit is installed on the base casing 101E.

The four magnetostrictive actuators 103 are driven by the driving system, for example, one shown in FIG. 8 based on the same high range component SAH, so that their driving rods 103*a* can displace corresponding to their corresponding high range component SAH. Alternatively, these four magnetostrictive actuators 103 are respectively driven by the driving system, for example, one shown in FIG. 17 based on the separate high range components SAH1 though SAH4, so that their driving rods 103*a* can displace corresponding to their corresponding high range components SAH1 through SAH4, respectively.

Remaining parts of the speaker 100E shown in FIG. 24 is similar to those of the speaker 100A shown in FIG. 2. The pipe member 102 and the magnetostrictive actuators 103 in the speaker 100E operate similar to the operations of those in the speaker 100A shown in FIG. 2, thereby obtaining an acoustic output of high range corresponding to the high range component SAH from an outer surface of the pipe member 102.

According to the speaker 100E, similar to the speaker 100A shown in FIG. 2, the magnetostrictive actuators 103 driven based on the high range component SAH of the monaural acoustic signal SA vibrate with the lower end surface of the pipe member 102 by their component of vibration orthogonal to the lower end surface of the pipe member 102. This prevents large transverse wave from occurring at a vibration point. Therefore, a listener does not listen to sound wave from the vibration point being sounded very loud, as compared by that from another position, so that an acoustic image can be created over a whole of the pipe member 102 in its longitudinal direction. This causes a global acoustic image to be obtained.

Figure 25:
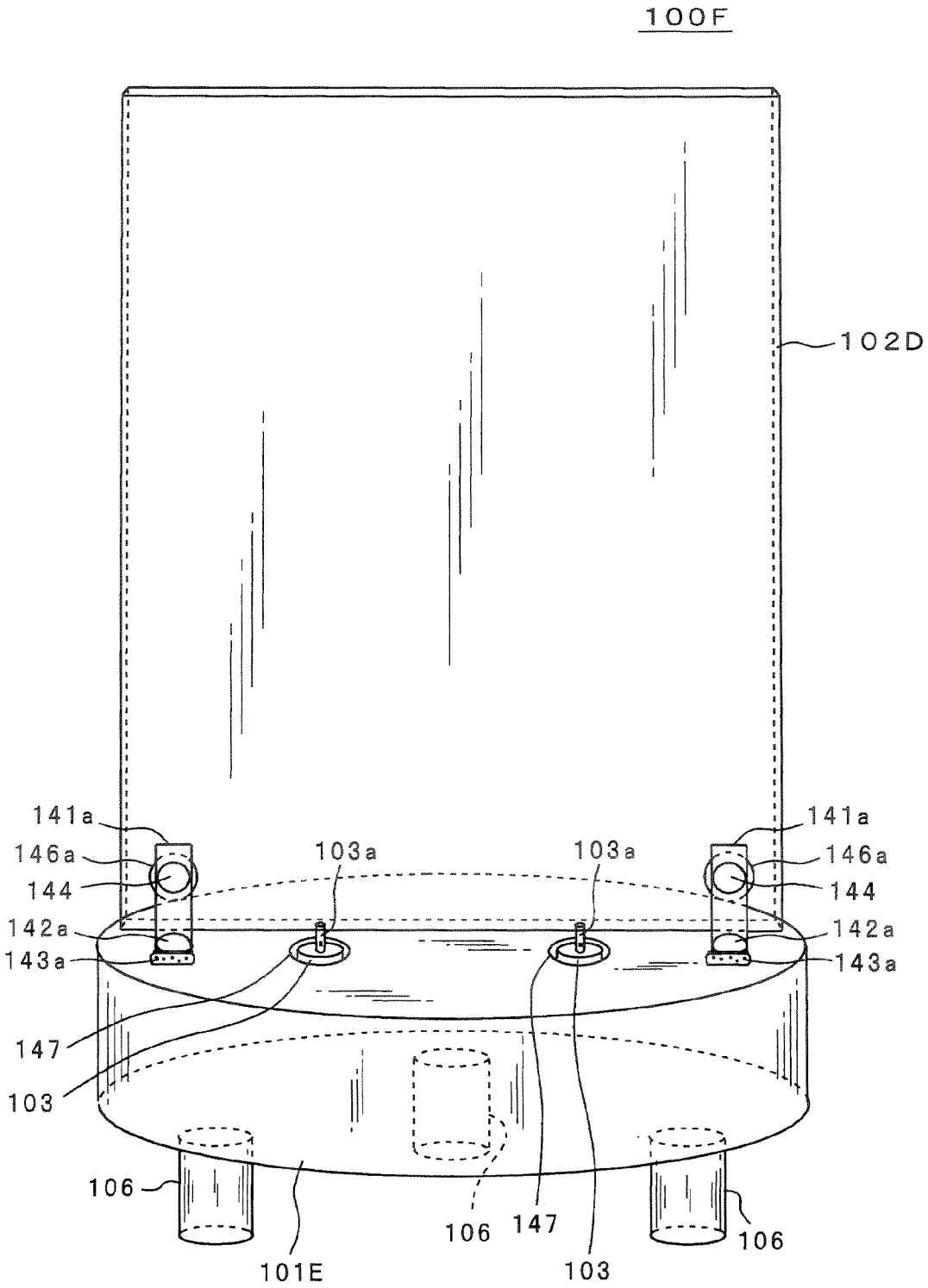
FIG. 25 is a perspective view of a speaker 100F according to a still further embodiment of the invention.

The following will describe a speaker 100F according to a still further embodiment of the invention. FIG. 25 shows a configuration of the speaker 100F according to the still further embodiment of the invention. FIG. 25 shows a perspective view of the speaker 100F. In FIG. 25, like reference numbers refer to like elements of FIG. 22, a detailed explanation of which will be omitted.

In this speaker 100F, a disk-like base casing 101E having no opening is used in place of the base casing 101 of the speaker 100D shown in FIG. 22. The acrylic plate 102D is set on a top surface of the disk-like base casing 101E and two magnetostrictive actuators 103 are contained and set therein. How to set this acrylic plate 102D and the magnetostrictive actuators 103 is similar to that of the speaker 100D shown in FIG. 22, a detailed explanation of which will be omitted.

It is to be noted that in this speaker 100F, no speaker unit is installed on the base casing 101E.

The two magnetostrictive actuators 103 are driven by the driving system, for example, one shown in FIG. 8 based on the same high range component SAH, so that their driving rods 103*a* can displace corresponding to their corresponding high range component SAH. Alternatively, these two magnetostrictive actuators 103 are respectively driven by the driving system, for example, one shown in FIG. 17 based on the separate high range components SAH1 and SAH2, so that their driving rods 103*a* can displace corresponding to their corresponding high range components SAH1 and SAH2, respectively.

Remaining parts of the speaker 100F shown in FIG. 25 is similar to those of the speaker 100D shown in FIG. 22. The acrylic plate 102D and the magnetostrictive actuators 103 in the speaker 100F operate similar to the operations of those in the speaker 100D shown in FIG. 22, thereby obtaining an acoustic output of high range corresponding to the high range component SAH from the outer surfaces of the acrylic plate 102D.

According to the speaker 100F, similar to the speaker 100D shown in FIG. 22, the magnetostrictive actuators 103 driven based on, for example, the high range component SAH of the monaural acoustic signal SA vibrate with the lower end surface of the acrylic plate 102D by their component of vibration orthogonal to the lower end surface of the acrylic plate 102D (along a plane direction of the acrylic plate 102D). This prevents large transverse wave from occurring at a vibration point. Therefore, a listener does not listen to sound wave from the vibration point being sounded very loud, as compared by that from another position, so that an acoustic image can be created over a whole surface of the acrylic plate 102D. This causes a global acoustic image to be obtained.

Figure 26:
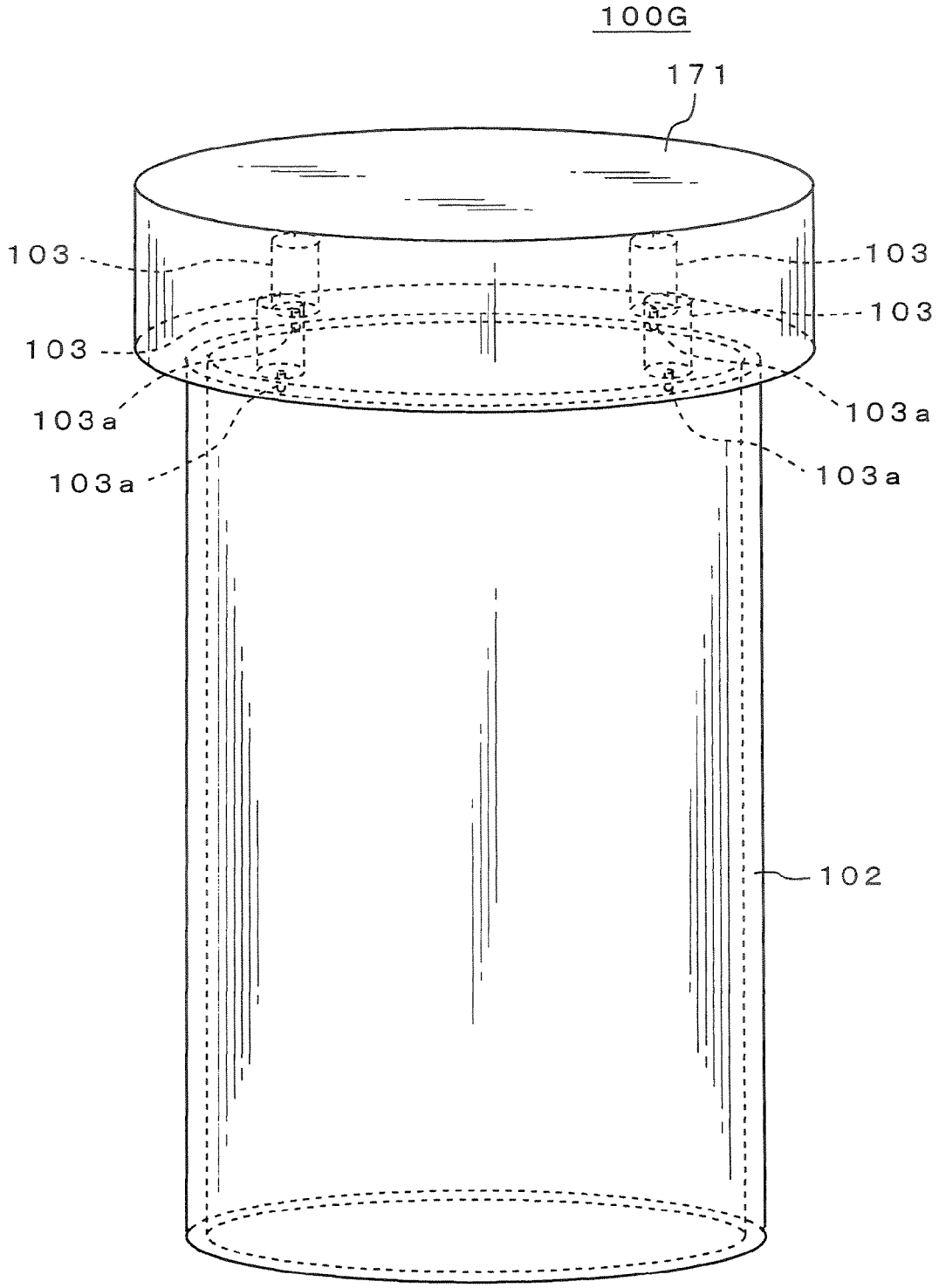
FIG. 26 is a perspective view of a speaker 100G according to a still additional embodiment of the invention.
Figure 27:
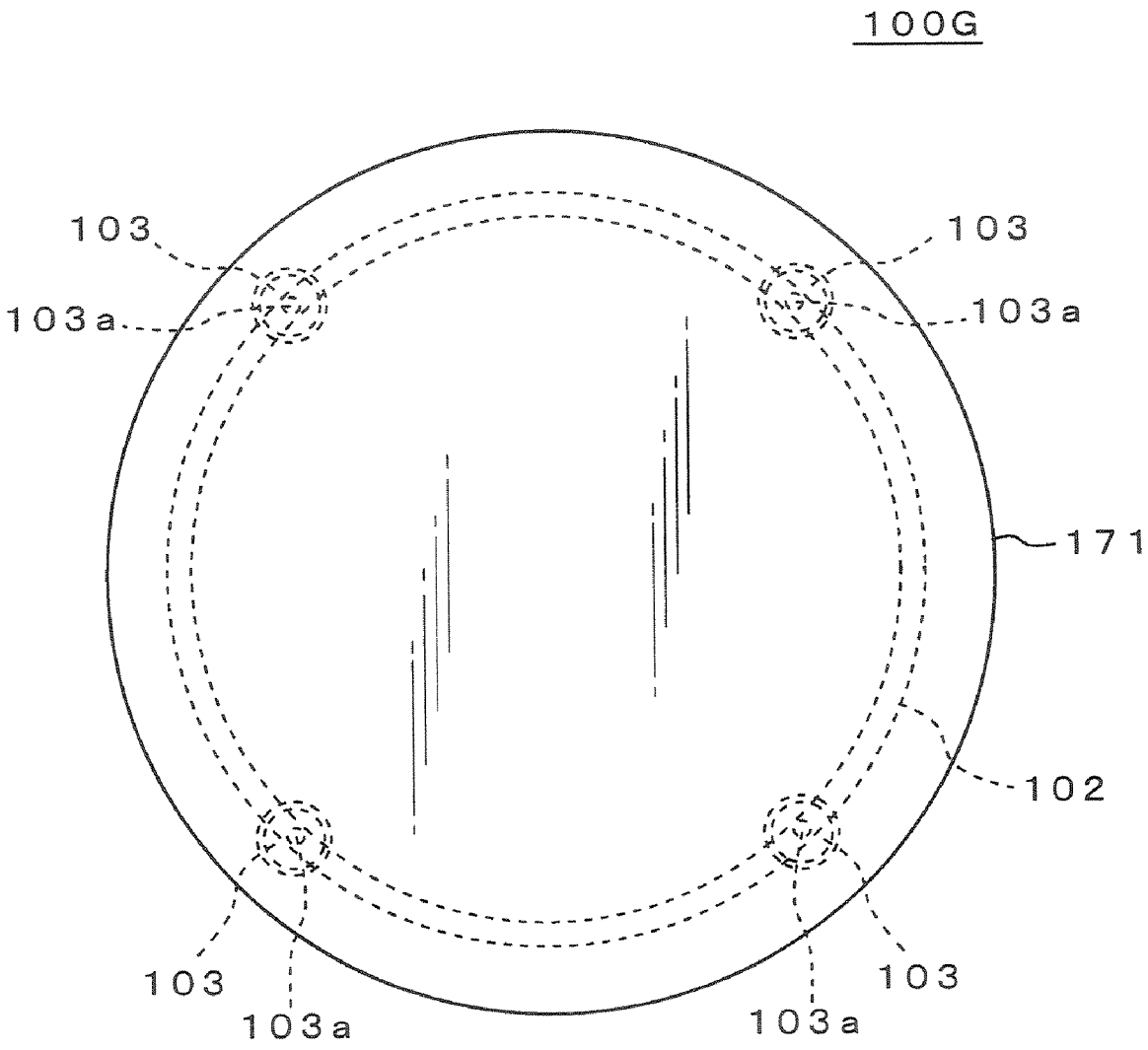
FIG. 27 is a top plan view of the speaker 100G according to the still additional embodiment of the invention.

The following will describe a speaker 100G according to a still additional embodiment of the invention. FIGS. 26 and 27 show a configuration of the speaker 100G according to the still additional embodiment of the invention. FIG. 26 is a perspective view of the speaker 100G and FIG. 27 is a top plan view of the speaker 100G. In FIGS. 26 and 27, like reference numbers refer to like elements of FIGS. 2 through 5, a detailed explanation of which will be omitted.

This speaker 100G has a casing 171, a pipe member 102 as an acoustic diaphragm, and magnetostrictive actuators 103 as actuators. The casing 171 is made of, for example, synthetic resin and has a disk-like shape. This casing 171 is mounted on a top of the pipe member 102.

Plural magnetostrictive actuators 103, in this embodiment, four magnetostrictive actuators are set in the casing 171 with them being faced upside down. These four magnetostrictive actuators 103 are positioned at the same distance on and along a circular top end surface of the pipe member 102. On the bottom surface of the casing 171, hollows, not shown, each for containing the magnetostrictive actuator 103 are formed. The magnetostrictive actuators 103 are respectively set in the casing 171 with them being contained in the hollows.

When forward ends of the four magnetostrictive actuators 103 set and contained in the casing 171 are respectively connected with the top end surface of the pipe member 102. In this embodiment, a displacement direction of each of the driving rods 103*a* is oriented along a direction orthogonal to the top end surface of the pipe member 102, namely, an axial direction of the pipe member 102. This axial direction corresponds to a direction along a plane of the pipe member 102 (a direction parallel to the plane of the pipe member 102). Such a configuration enables the magnetostrictive actuators 103 to vibrate with the upper end surface of the pipe member 102 by their component of the vibration that is orthogonal to the upper end surface of the pipe member 102.

The four magnetostrictive actuators 103 are driven by the driving system, for example, one shown in FIG. 8 based on the same high range component SAH, so that their driving rods 103*a* can displace corresponding to the high range component SAH. Alternatively, these four magnetostrictive actuators 103 are respectively driven by the driving system, for example, one shown in FIG. 17 based on the separate high range components SAH1 though SAH4, so that their driving rods 103*a* can displace corresponding to their corresponding high range components SAH1 through SAH4, respectively.

The pipe member 102 and the magnetostrictive actuators 103 in the speaker 100G operate similar to the operations of those in the speaker 100A shown in FIG. 2, thereby obtaining an acoustic output of high range corresponding to the high range component SAH from an outer surface of the pipe member 102.

According to the speaker 100G, similar to the speaker 100A shown in FIG. 2, the magnetostrictive actuators 103 driven based on the high range component SAH of the monaural acoustic signal SA vibrate with the upper end surface of the pipe member 102 by their component of vibration orthogonal to the upper end surface of the pipe member 102. This prevents large transverse wave from occurring at a vibration point. Therefore, a listener does not listen to sound wave from the vibration point being sounded very loud, as compared by that from another position, so that an acoustic image can be created over a whole of the pipe member 102 in its longitudinal direction. This causes a global acoustic image to be obtained.

According to the speaker 100G, the magnetostrictive actuators 103 are set in the casing 171 mounted on the top end surface of the pipe member 102 so that each of the magnetostrictive actuators 103 has no fixation and any vibration can propagate to the pipe member 102 by inertia force. This enables the magnetostrictive actuators 103 to be unrestrained, thereby causing a less distortion in the sound image.

Figure 28:
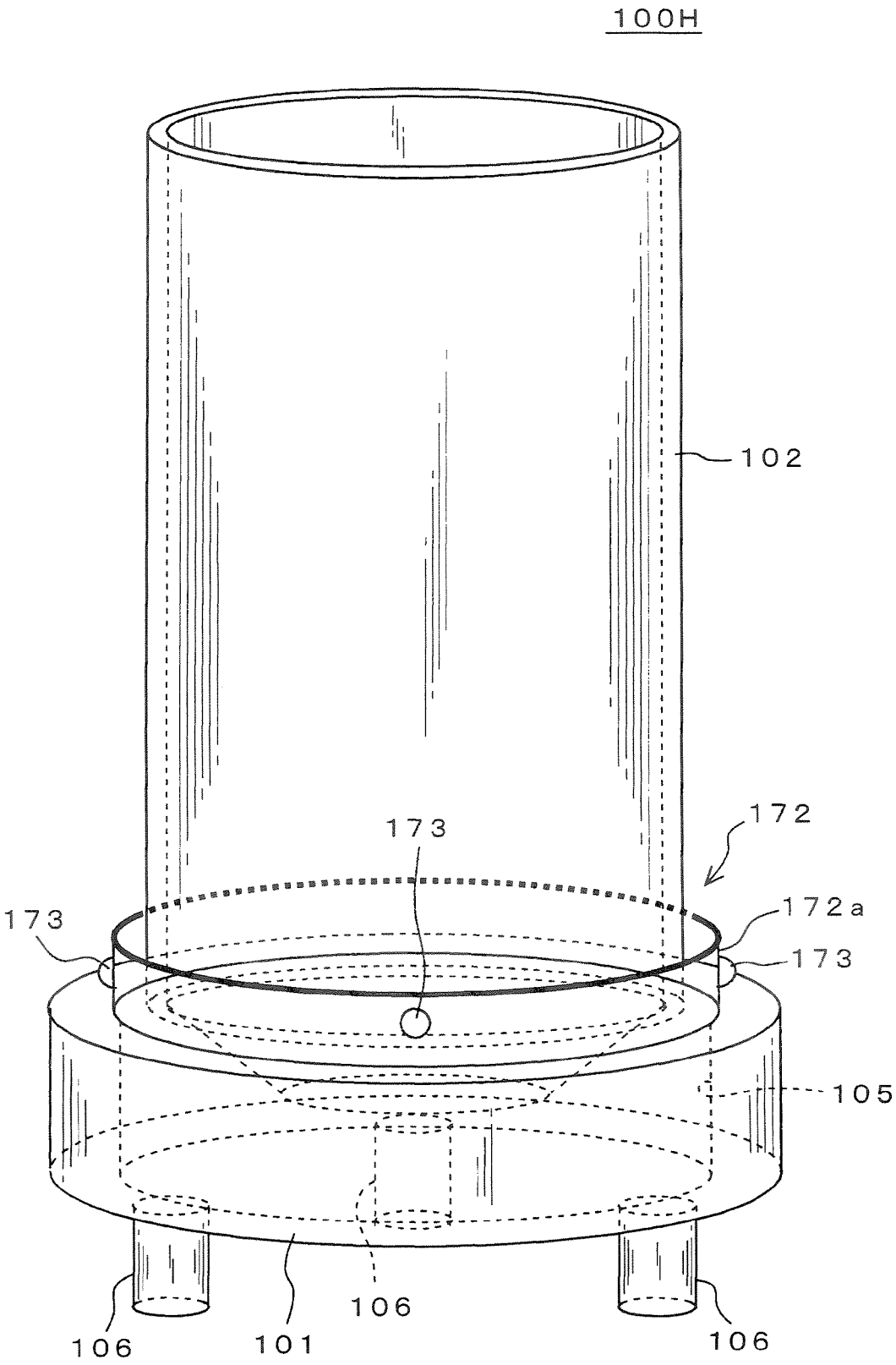
FIG. 28 is a perspective view of a speaker 100H according to an even further embodiment of the invention.
Figure 29:
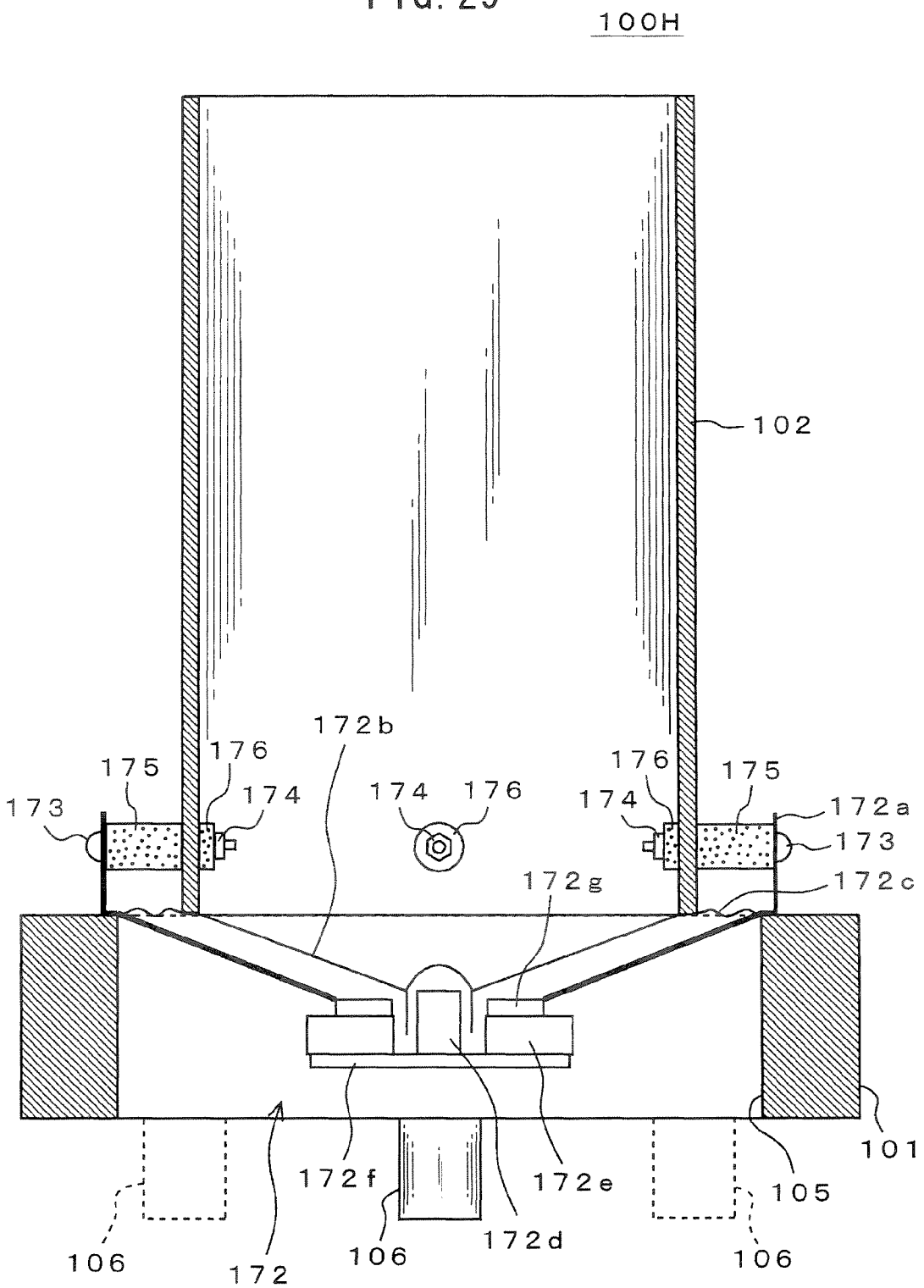
FIG. 29 is a vertical sectional view of the speaker 100H according to the even further embodiment of the invention.

The following will describe a speaker 100H according to an even further embodiment of the invention. FIGS. 28 and 29 show a configuration of the speaker 100H according to the even further embodiment of the invention. FIG. 28 is a perspective view of the speaker 100H and FIG. 29 is a vertical sectional view of the speaker 100H. In FIGS. 28 and 29, like reference numbers refer to like elements of FIGS. 2 and 3, a detailed explanation of which will be omitted.

This speaker 100H has a base casing 101, a pipe member 102 as an acoustic diaphragm, and a speaker unit 172 as an electrodynamic actuator.

The speaker unit 172 is installed on the base casing 101 with it being faced upwardly and closing the opening 105. This speaker unit 172 has, as shown in FIG. 29, a unit frame 172*a*, a cone 172*b*, an edge 172*c*, a pole piece 172*d*, a magnet 172*e*, a yoke 172*f*, and a top plate 172*g*.

A lower end portion of the pipe member 102 is set to the unit frame 172*a* at plural positions, in this embodiment, four positions. In each of the unit frame 172*a* and the pipe member 102, round holes each for a screw, not shown, are respectively bored. The lower end portion of the pipe member 102 is secured to the unit frame 172*a* by screws 173 and nuts 174. Damper members 175, 176 each constituted of ring-shaped rubber member stand between the frame unit 172*a* and an outer surface of the pipe member 102 and between the nut 174 and an inner surface of the pipe member 102.

When the lower end portion of the pipe member 102 is set to the unit frame 172*a*, as described above, the lower end surface of the pipe member 102 is attached to the cone 172*b* of the speaker unit 172. The cone 172*b* constitutes a transmission portion of the actuator that transmits a displacement output of the actuator to the acoustic diaphragm. Such a configuration enables the cone 172*b* of the speaker unit 172 to vibrate with the lower end surface of the pipe member 102 by its component of the vibration orthogonal.

The damper members 175, 176 thus intervened prevent any vibration by the cone 172*b* of the speaker unit 172 from propagating to the base casing 101 thorough the pipe member 102 and the unit frame 172*a*, thereby avoiding localizing any sound image to the base casing 101.

The speaker unit 172 is driven by, for example, the high range component SAH extracted from the monaural acoustic signal SA so that the cone 172*b* can displace corresponding to the high range component SAH.

The following describe operations of the speaker 100H shown in FIGS. 28 and 29.

The speaker unit 172 attached to the base casing 101 is driven by the high range component SAH of the monaural acoustic signal SA. The cone 172*b* thereof displaces corresponding to the high range component SAH. Based on the displacement of the cone 172*b*, the lower end surface of the pipe member 102 vibrates by a component of the vibration by the cone 172*b* that is orthogonal to the lower end surface of the pipe member 102 (along a plane of the pipe member 102).

The lower end surface of the pipe member 102 is excited by a longitudinal wave and an elastic wave (vibration) propagates to the pipe member 102. When this elastic wave propagates to the pipe member 102, the elastic wave repeats mode exchanges of a longitudinal wave to a transverse wave and vice versa, so that the longitudinal wave and the transverse wave can be mingled therein. The transverse wave excites vibration in a horizontal direction of the pipe member 102 (i.e., a direction orthogonal to the plane of the pipe member 102). This enables sound wave to be emitted from the pipe member 102. In other words, an outer surface of the pipe member 102 can emit an acoustic output of high range that corresponds to the high range component SAH.

According to the speaker 100H shown in FIGS. 28 and 29, the speaker unit 172 driven based on the high range component SAH of the monaural acoustic signal SA vibrates with the lower end surface of the pipe member 102 by its component of vibration orthogonal to the lower end surface of the pipe member 102. This prevents large transverse wave from occurring at a vibration point. Therefore, a listener does not listen to sound wave from the vibration point being sounded very loud, as compared by that from another position, so that an acoustic image can be created over a whole of the pipe member 102 in its longitudinal direction. This causes a global acoustic image to be obtained.

Figure 30A:
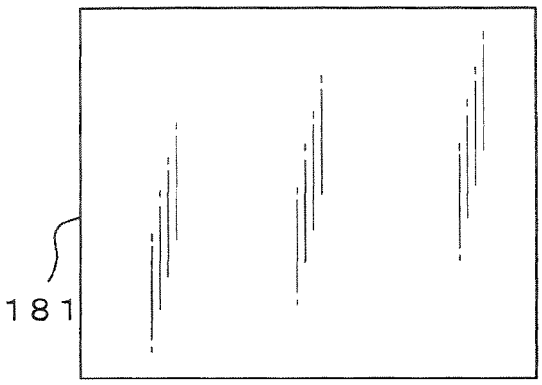
FIGS. 30A and 30B are diagrams each for illustrating how to manufacture a diaphragm of tube (pipe member) starting from a plate member.
Figure 30B:
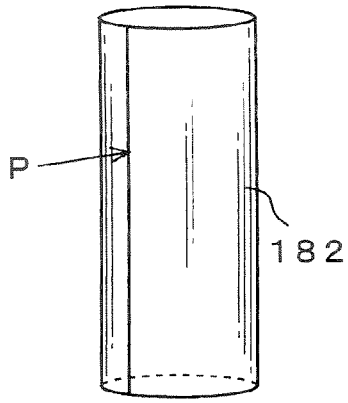
Figure 31:
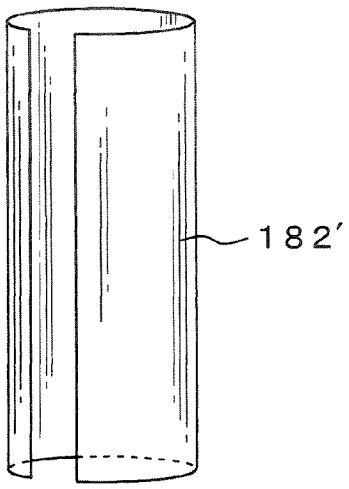
FIG. 31 is a diagram for showing a variation of the pipe member.

Although in the above embodiments, a cylindrical pipe member 102 has been used as an acoustic diaphragm having a tube shape, the invention is not limited thereto. A square pipe member may be used. Further, as the cylindrical pipe member, a plate member may be rolled to make it. This enables the acoustic diaphragm having a tube shape to be easily made. For example, a plate member 181 shown in FIG. 30A may be rolled to make the pipe member 182 shown in FIG. 30B. In this pipe member 182, edges indicated by an arrow P shown in FIG. 30B are adhered to each other by adhesive or the like. It is to be noted that as shown in FIG. 31, a pipe member 182' having a section of character of C that is made without adhering the edges thereof can be also used as an acoustic diaphragm having a tube shape.

Figure 32:
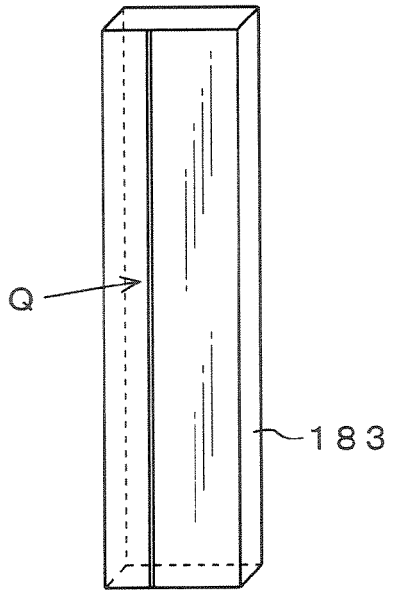
FIG. 32 is a diagram for showing anther variation of the pipe member.

FIG. 32 shows a square pipe member 183 that is made by folding a plate member. Although in this pipe member 183, edges, indicated by an arrow Q, are not adhered to each other so that it can be split by a slit, the invention is not limited thereto. The edges can be completely adhered to each other.

Figure 33:
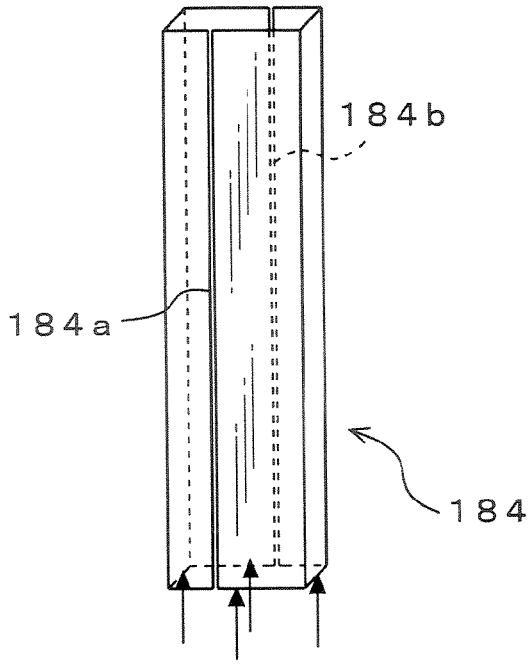
FIG. 33 is a diagram for showing a further variation of the pipe member (two-split)
Figure 34:
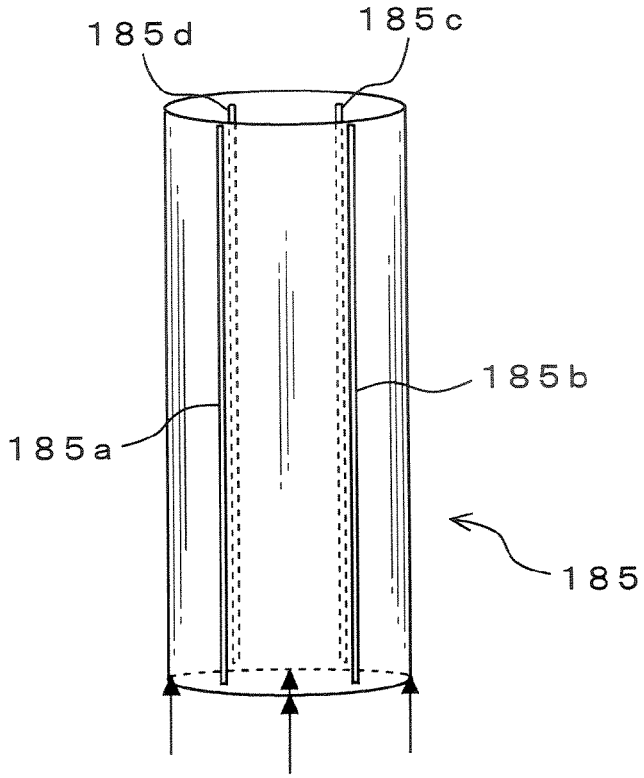
FIG. 34 is a diagram for showing an additional variation of the pipe member (four-split)

Although in the above embodiments, the acoustic diaphragm (the pipe member or the acrylic plate) with which the magnetostrictive actuators 103 vibrate has been shown as a single entity, the invention is not limited thereto. For example, as shown in FIG. 33, a square pipe member 184 that is split to at east two parts can be used. FIG. 33 shows a case where the square pipe member 184 is split by two slits 184*a*, 184*b*. Further, FIG. 34 shows a case where a pipe member 185 is split by four slits 185*a* through 185*d*.

It is to be noted that although in FIG. 33, the square pipe member 184 has been completely split by the slits 184*a*, 184*b*, the invention is not limited thereto. A pipe member that is partially split by the two slits, which have a length shorter than a whole length of the pipe member, can be used. Alternatively, although in FIG. 34, the pipe member 185 has been partially split by the slits 185*a* through 185*d*, the invention is not limited thereto. A pipe member that is completely split by the four slits, which have the same length as a whole length of the pipe member, can be used.

Arrows shown at bottoms of the pipe member 184, 185 indicate a direction to which a vibration is transmitted. Such a configuration where the acoustic diaphragm is split to at least two parts allows independence on excitation of each of the actuators to be secured, thereby performing the above sound field processing effectively.

Figure 35A:
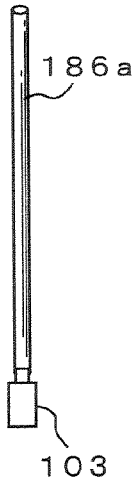
FIGS. 35A through 35H are diagrams each for illustrating shapes of the acoustic diaphragms.
Figure 35B:
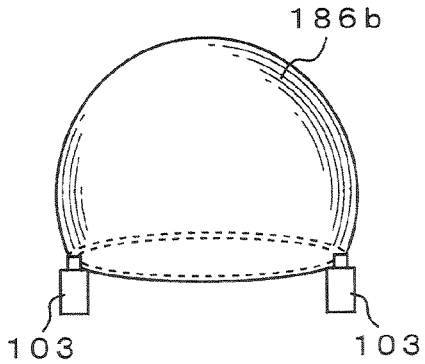
Figure 35G:
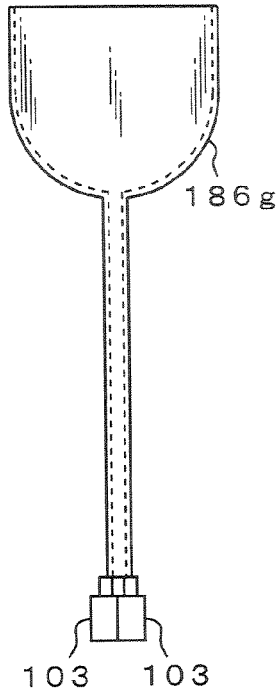
Figure 35C:
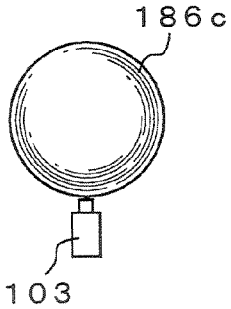
Figure 35E:
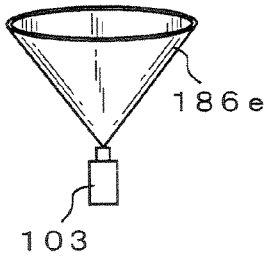
Figure 35H:
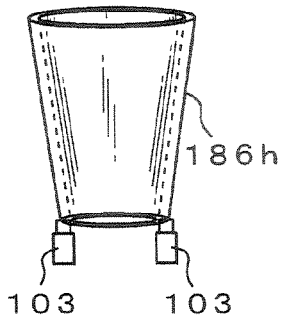
Figure 35D:
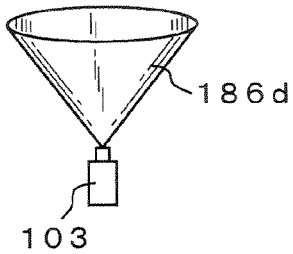
Figure 35F:
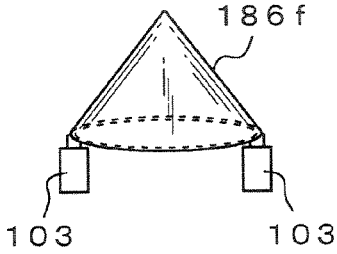

Although in the above embodiments, the pipe member 102 that is the acoustic diaphragm having a tube shape and the acrylic plate 102D that is the acoustic diaphragm having a plate shape have been used as the acoustic diaphragm, the invention is not limited thereto. An acoustic diaphragm having other shapes may be used. For example, FIG. 35A shows an acoustic diaphragm 186*a* having a rod shape; FIG. 35B shows an acoustic diaphragm 186*b* having a ball shell shape; FIG. 35C shows an acoustic diaphragm 186*c* having a ball shape; FIG. 35D shows an acoustic diaphragm 186*d* having a cone shape; FIGS. 35E and 35F respectively show an acoustic diaphragm 186*e*, 186*f* having a funnel shape; FIG. 35G shows an acoustic diaphragm 186*g* having a wineglass shape; and FIG. 35H shows an acoustic diaphragm 186*h* having cylindrical shape with its diameter becoming larger by degrees. It is to be noted that when the acoustic diaphragm has a cone shape or a funnel shape as shown in FIG. 35D or 35E, one magnetostrictive actuator 103 vibrates with a vertex of the cone or the funnel so that the acoustic diaphragms can attain its omni-directionality.

Even if these acoustic diaphragms are used, a level from the vibration point can be reduced when the magnetostrictive actuator(s) vibrate(s) with any one of the acoustic diaphragms by at least their (its) component of the vibration along a plane of this acoustic diagram, thereby enabling a global acoustic image to be obtained.

Figure 36A:
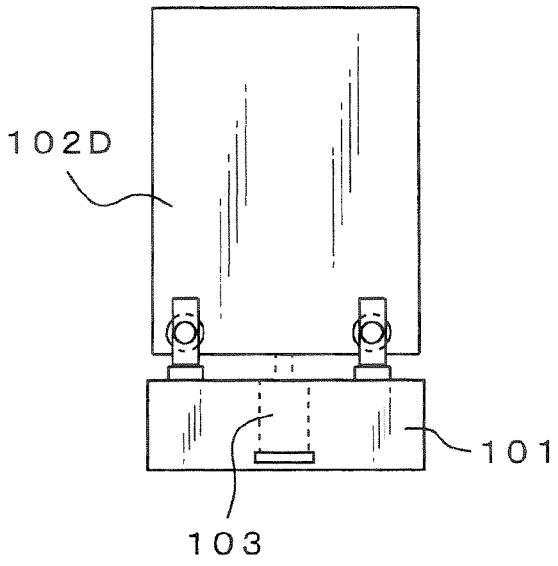
FIGS. 36A and 36B are diagrams each for illustrating variations of the acoustic diaphragm.
Figure 36B:
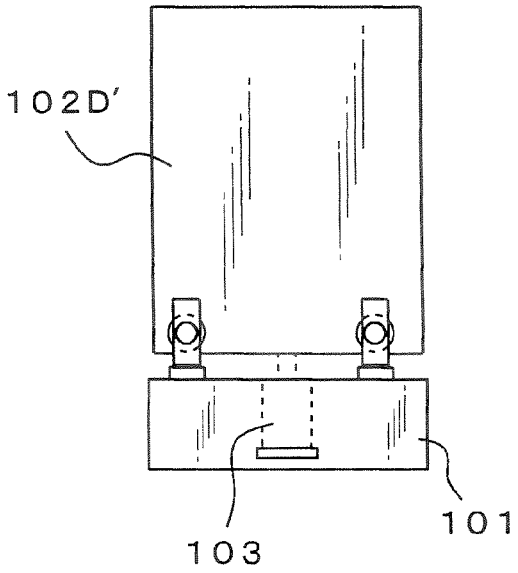

In the above embodiments, the pipe member 102 and the acrylic plate 102D have been set on the top surface of the base casing 101 by the lower end surface thereof (see FIGS. 2 and 22). If so, they can be fastened or unfastened by screws 109, 142*a* so that they are attachable or detachable as desired. In this moment, a user can change the acoustic diaphragm at his or her option so that the acrylic plate 102D can be set on the base casing 101 as shown in FIG. 36A or a wooden board 102D' can be set on the base casing 101 as shown in FIG. 36B.

Thus, setting the acoustic diaphragm detachably on the base casing 101 allows the user to select an optional acoustic diaphragm among a plurality of species of acoustic diaphragms having different materials, sizes, and shapes and attach it to the base casing 101, thereby enabling various kinds of tone colors and looks to be attained.

Figure 37:
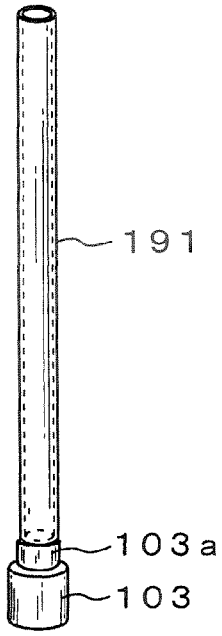
FIG. 37 is a diagram for illustrating a vibration method for the acoustic diaphragm.

In the speaker 100A shown in FIG. 2, the four magnetostrictive actuators 103 positioned at the same distance under and along a circular lower end surface of the pipe member 102 have vibrated with the pipe member 102 by their component of vibration orthogonal to the lower end surface of the pipe member 102 so that an outer whole surface of the pipe member 102 can emit an acoustic output of high range with omni-directionality. If a driving rod 103*a* of one magnetostrictive actuator 103 is attached to a whole lower end surface of a pipe member 191 and the magnetostrictive actuator 103 vibrates with the pipe member 191 as shown in FIG. 37, it is possible for an outer whole surface of the pipe member 191 to emit an acoustic output of high range with omni-directionality Although in the speaker 100A shown in FIG. 2 and the speaker 100D shown in FIG. 22, the driving rod 103*a* of each of the magnetostrictive actuators 103 has been directly attached to the lower end surface of each of the pipe member 102 and the acrylic plate 102D as the acoustic diaphragm, this invention is not limited thereto. The driving rod 103*a* of each of the magnetostrictive actuators 103 can be indirectly attached to the acoustic diaphragm and vibrate with it.

Figure 38A:
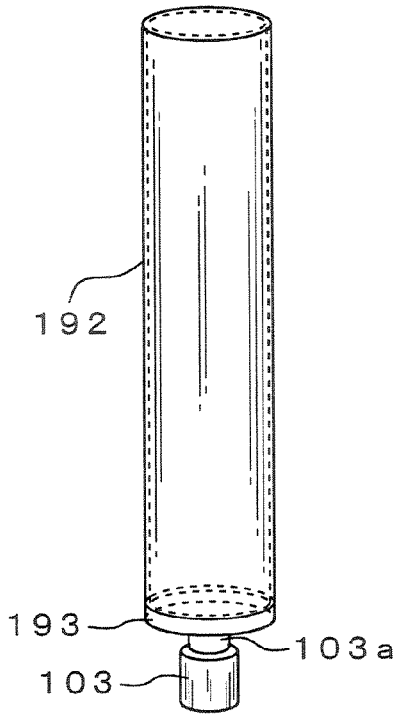
FIGS. 38A and 38B are diagrams each for illustrating another vibration method for the acoustic diaphragm.
Figure 38B:
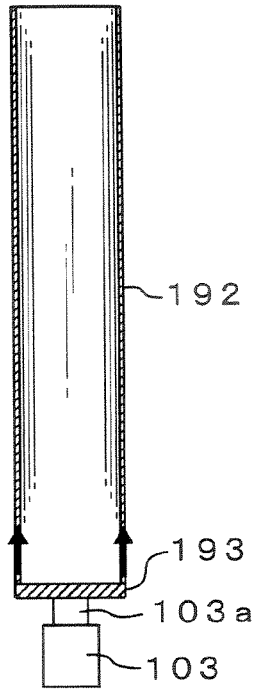

For example, FIGS. 38A and 38B show a case of an acoustic diaphragm in which an acrylic disk plate 193 is attached to a whole lower end surface of the pipe member 192 and the driving rod 103*a* of the magnetostrictive actuator 103 is attached to a lower end surface of this acrylic disk plate 193. FIG. 38A shows a perspective view of this acoustic diaphragm and FIG. 38B shows a vertical sectional view thereof. In this acoustic diaphragm, for example, a thin and light polycarbonate pipe of 0.5 mm can be used as the pipe member 192 so that the magnetostrictive actuator 103 can vibrate with the pipe member 192 by its component of vibration orthogonal to the lower end surface of the pipe member 192, thereby enabling an outer whole surface of the pipe member 192 to emit an acoustic output of high range with omni-directionality. It is to be noted that arrows shown in FIG. 38B indicate a direction to which any vibration is transmitted in the pipe member 192. Such a configuration can be implemented by one magnetostrictive actuator 103 at a low price.

Figure 39A:
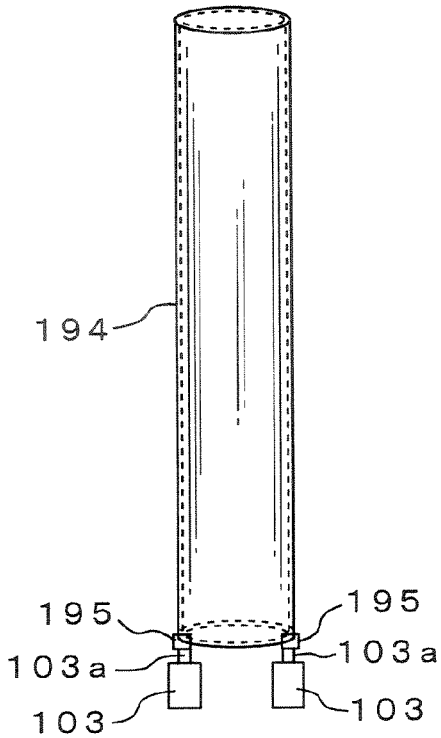
FIGS. 39A and 39B are diagrams each for illustrating further vibration method for the acoustic diaphragm.
Figure 39B:
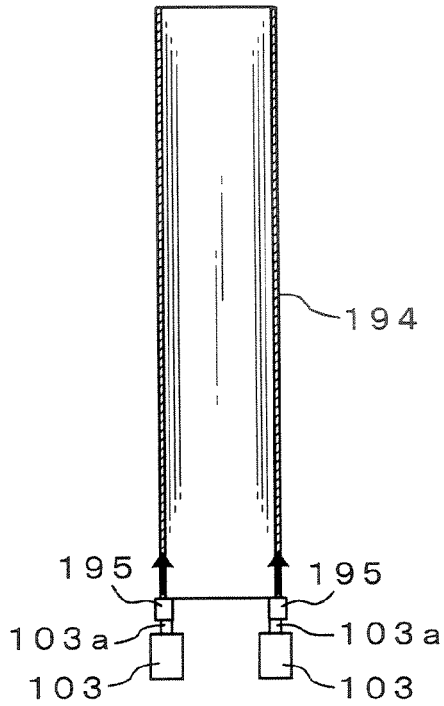

Further, FIGS. 39A and 39B show a case of an acoustic diaphragm in which, for example, two magnetostrictive actuators 103 positioned at the same distance under and along a circular lower end surface of an acrylic pipe member 194 vibrate with the pipe member 194 by their component of vibration orthogonal to the lower end surface of the pipe member 194 and insert plates 195 respectively stay between the driving rods 103*a* of the magnetostrictive actuators 103 and the lower end surface of the pipe member 194. FIG. 39A shows a perspective view of this acoustic diaphragm and FIG. 39B shows a vertical sectional view thereof. In this acoustic diaphragm, the insert plates 195 can be made of various kinds of materials such as wood, aluminum, and glass. Since characteristic vibration mode is different from each other based on the materials, any different kinds of tone colors can be obtained based on the selected material.

Although in the above embodiments, the magnetostrictive actuator and the electrodynamic actuator have been used as the actuator, this invention is not limited thereto. Of course, a piezoelectric actuator or the like may be used as the actuator to implement the same speaker as those of the above embodiments.

According to the above embodiments of the invention, it is possible to obtain a global acoustic image within an acceptable wide range so that this invention is applicable to a speaker or the like that is available for the audio-visual equipment.

It should be understood by those skilled in the art that various modifications, combinations, sub-combinations and alternations may occur depending on design requirements and other factors insofar as they are within the scope of the appended claims or the equivalents thereof.

What is claimed is:

1. A speaker comprising:

an acoustic diaphragm; and an actuator that is driven based on an acoustic signal, said actuator having a transmission portion that transmits a displacement output of the actuator to the acoustic diaphragm, said transmission portion being attached to the acoustic diaphragm either directly or indirectly, wherein the actuator vibrates with the acoustic diaphragm by at least its component of the vibration along a plane of the acoustic diaphragm, the acoustic diaphragm has a tube shape and the transmission portion of the actuator is attached to an end surface of one side of the acoustic diaphragm with the tube shape; and the acoustic diaphragm with the tube shape is made of rolled plate member.

2. The speaker according to claim 1 , wherein the actuator vibrates with the acoustic diaphragm by at least its component of vibration orthogonal to the end surface of the acoustic diaphragm.

3. The speaker according to claim 1, wherein a plurality of the actuators is provided, and transmission portions of the actuators are respectively attached to different positions of the acoustic diaphragm.

4. The speaker according to claim 3, wherein the plurality of the actuators is driven by the same acoustic signal.

5. The speaker according to claim 3, wherein the plurality of the actuators is respectively driven by the separate acoustic signals.

6. The speaker according to claim 1, wherein the actuator is any one of a magnetostrictive actuator and an electrodynamic actuator.

7. A speaker comprising:

an acoustic diaphragm;

an actuator that is driven based on an acoustic signal, said actuator having a transmission portion that transmits a displacement output of the actuator to the acoustic diaphragm, said transmission portion being attached to the acoustic diaphragm either directly or indirectly; and a base casing, wherein the actuator vibrates with the acoustic diaphragm by at least its component of the vibration along a plane of the acoustic diaphragm, the actuator is set on the base casing, and the acoustic diaphragm is set on the base casing through a damper member.

8. The speaker according to claim 7, wherein the acoustic diaphragm is detachably set on the base casing.

9. The speaker according to claim 7, wherein the acoustic diaphragm is set with its one end being put at lower side, and the actuator is mounted on the other end of the acoustic diaphragm with the transmission portion of the actuator being attached to the other end of the acoustic diaphragm.

10. The speaker according to claim 7, wherein a plurality of the actuators is provided, and transmission portions of the actuators are respectively attached to different positions of the acoustic diaphragm.

11. The speaker according to claim 10, wherein the plurality of the actuators are driven by the same acoustic signal.

12. The speaker according to claim 10, wherein the plurality of the actuators are respectively driven by the separate acoustic signals.

13. The speaker according to claim 7, wherein the actuator is any one of a magnetostrictive actuator and an electrodynamic actuator.

14. The speaker according to claim 7, wherein the acoustic diaphragm has an end surface, and the actuator vibrates with the acoustic diaphragm by at least its component of vibration orthogonal to the end surface of the acoustic diaphragm.

15. A speaker comprising:

an acoustic diaphragm; and an actuator that is driven based on an acoustic signal, said actuator having a transmission portion that transmits a displacement output of the actuator to the acoustic diaphragm, said transmission portion being attached to the acoustic diaphragm either directly or indirectly, wherein the actuator vibrates with the acoustic diaphragm by at least its component of the vibration along a plane of the acoustic diaphragm, a plurality of actuators is provided, transmission portions of the actuators are respectively attached to different positions of the acoustic diaphragm, the acoustic diaphragm includes a plurality of split acoustic diaphragms and the transmission portions of the plurality of the actuators are respectively attached to the corresponding split acoustic diaphragms.

16. The speaker according to claim 15, wherein the plurality of the actuators are driven by the same acoustic signal.

17. The speaker according to claim 15, wherein the plurality of the actuators are respectively driven by the separate acoustic signals.

18. The speaker according to claim 15, wherein the actuator is any one of a magnetostrictive actuator and an electrodynamic actuator.

19. The speaker according to claim 15, wherein the acoustic diaphragm has an end surface; and the actuator vibrates with the acoustic diaphragm by at least its component of vibration orthogonal to the end surface of the acoustic diaphragm.

* * * * *